US009674632B2

(12) United States Patent
Xiang et al.

(10) Patent No.: US 9,674,632 B2
(45) Date of Patent: Jun. 6, 2017

(54) FILTERING WITH BINAURAL ROOM IMPULSE RESPONSES

(71) Applicant: QUALCOMM Incorporated, San Diego, CA (US)

(72) Inventors: Pei Xiang, San Diego, CA (US); Dipanjan Sen, San Diego, CA (US); Nils Günther Peters, San Diego, CA (US); Martin James Morrell, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 8 days.

(21) Appl. No.: 14/288,293

(22) Filed: May 27, 2014

(65) Prior Publication Data

US 2014/0355796 A1 Dec. 4, 2014

Related U.S. Application Data

(60) Provisional application No. 61/828,620, filed on May 29, 2013, provisional application No. 61/847,543,
(Continued)

(51) Int. Cl.
*H04S 7/00* (2006.01)
*H04S 5/00* (2006.01)
(Continued)

(52) U.S. Cl.
CPC ..... *H04S 7/305* (2013.01); *H04S 5/00* (2013.01); *H04S 7/307* (2013.01); *G10K 15/12* (2013.01);
(Continued)

(58) Field of Classification Search
CPC ..... H04S 1/002; H04S 1/005; H04S 3/004; H04S 5/00; H04S 7/305; H04S 7/306;
(Continued)

(56) References Cited

U.S. PATENT DOCUMENTS 5,371,799 A * 12/1994 Lowe ..... H04S 1/005 381/17
5,544,249 A 8/1996 Opitz
(Continued)

FOREIGN PATENT DOCUMENTS

CN 1735922 A 2/2006
CN 101884065 A 11/2010
(Continued)

OTHER PUBLICATIONS

Wikipedia, Noise gate, published Nov. 2012 (http://web.archive.org/web/20121114164226/https://en.wikipedia.org/wiki/Noise_gate).*
(Continued)

*Primary Examiner* — Mark Fischer
(74) *Attorney, Agent, or Firm* — Shumaker & Sieffert, P.A.

(57) ABSTRACT

A device comprising one or more processors is configured to determine a plurality of segments for each of a plurality of binaural room impulse response filters, wherein each of the plurality of binaural room impulse response filters comprises a residual room response segment and at least one direction-dependent segment for which a filter response depends on a location within a sound field; transform each of at least one direction-dependent segment of the plurality of binaural room impulse response filters to a domain corresponding to a domain of a plurality of hierarchical elements to generate a plurality of transformed binaural room impulse response filters, wherein the plurality of hierarchical elements describe a sound field; and perform a fast convolution of the plurality of transformed binaural room impulse response filters and the plurality of hierarchical elements to render the sound field.

17 Claims, 12 Drawing Sheets

Related U.S. Application Data filed on Jul. 17, 2013, provisional application No. 61/886,593, filed on Oct. 3, 2013, provisional application No. 61/886,620, filed on Oct. 3, 2013.

(51) Int. Cl.

| | |
|---|---|
| *G10K 15/12* | (2006.01) |
| *G10L 19/008* | (2013.01) |
| *H04S 1/00* | (2006.01) |
| *H04S 3/00* | (2006.01) |

(52) U.S. Cl.

CPC ..... *G10L 19/008* (2013.01); *H04S 1/002* (2013.01); *H04S 1/005* (2013.01); *H04S 3/004* (2013.01); *H04S 7/306* (2013.01); *H04S 2400/01* (2013.01); *H04S 2420/01* (2013.01); *H04S 2420/07* (2013.01); *H04S 2420/11* (2013.01)

(58) Field of Classification Search

CPC .. H04S 7/307; H04S 2400/01; H04S 2420/01; H04S 2420/07; H04S 2420/11; G10K 15/08; G10K 15/10; G10K 15/12; G10L 19/008

See application file for complete search history.

(56) References Cited

U.S. PATENT DOCUMENTS

| | | | | |
|---|---|---|---|---|
| 8,705,319 | B2 | 4/2014 | Kallinger et al. | |
| 8,880,413 | B2 | 11/2014 | Virette | |
| 8,965,000 | B2 | 2/2015 | Engdegard | |
| 9,319,794 | B2 | 4/2016 | Betlehem | |
| 9,449,601 | B2 | 9/2016 | Kim et al. | |
| 2006/0045275 | A1 | 3/2006 | Daniel | |
| 2008/0273708 | A1 | 11/2008 | Sandgren et al. | |
| 2009/0110033 | A1* | 4/2009 | Shattil | H04B 1/7174 375/141 |
| 2009/0292544 | A1 | 11/2009 | Virette et al. | |
| 2011/0091046 | A1 | 4/2011 | Villemoes | |
| 2011/0261966 | A1* | 10/2011 | Engdegard | G10L 19/008 381/1 |
| 2013/0064375 | A1* | 3/2013 | Atkins | H04S 7/301 381/17 |
| 2013/0223658 | A1* | 8/2013 | Betlehem | H04S 3/002 381/307 |
| 2014/0355794 | A1 | 12/2014 | Morrell et al. | |
| 2014/0355795 | A1 | 12/2014 | Xiang et al. | |
| 2016/0269848 | A1 | 9/2016 | Mitsufuji et al. | |

FOREIGN PATENT DOCUMENTS

| | | | |
|---|---|---|---|
| CN | 102257562 | A | 11/2011 |
| EP | 1072089 | B1 | 3/2011 |
| JP | 2010508545 | | 3/2010 |
| JP | 2011066868 | | 3/2011 |
| JP | 2013536477 | A | 9/2013 |
| WO | 2008003881 | A1 | 1/2008 |
| WO | 2008100100 | A1 | 8/2008 |
| WO | 2009046223 | A1 | 4/2009 |
| WO | 2009046223 | A2 | 4/2009 |
| WO | 2012023864 | A1 | 2/2012 |
| WO | 2012025512 | A1 | 3/2012 |
| WO | 2015076419 | A1 | 5/2015 |

OTHER PUBLICATIONS

Abel, et al., "A Simple, Robust Measure of Reverberation Echo Density," Audio Engeineering Society, Oct. 5-8, 2006, 10 pp.

Beliczynski, et al., "Approximation of FIR by IIR Digital Filters: An Algorithm Based on Balanced Model Reduction," IEEE Transactions on Signal Processing, vol. 40, No. 3, Mar. 1992, pp. 532-542.

Rafaely, et al., "Interaural cross correlation in a sound field represented by spherical harmonics," J. Acoust. Soc. Am. 127, Feb. 2010, pp. 823-828.

Favrot, et al., "LoRA: A Loudspeaker-Based Room Auralization System," ACTA Acustica United with Acustica, vol. 96, Mar.-Apr. 2010, pp. 364-375.

Mezer, et al., "Investigations on an Early-Reflection-Free Model for BRIR's," J. Audio Eng. Soc., vol. 58, No. 9, Sep. 2010, pp. 709-723.

Hellerud, et al., "Encoding higher order ambisonics with AAC," Audio Engineering Society, May 17-20, 2008, 9 pp.

Huopaniemi, et al., "Spectral and Time-Domain Preprocessing and the Choice of Modeling Error Criteria for Binaural Digital Filters," AES 16th International Conference, Mar. 1999, pp. 301-312.

Jot, et al., "Digital signal processing issues in the context of binaural and transaural stereophony," Audio Engineering Society, Feb. 25-28, 1995, 47 pp.

Jot, et al., "Approaches to binaural synthesis," Jan. 1991, Retrieved from the Internet: URL:http://www.aes.org/elib/inst/download.cfm/8319.pdf?ID=8319, XP055139498, 13 pp.

Lindau, et al., "Perceptual Evaluation of Model-and Signal-Based Predictors of the Mixing Time in Binaural Room Impulse Responses," J. Audio Eng. Soc., vol. 60, No. 11, Nov. 2012, pp. 887-898.

"Draft Call for Proposals for 3D Audio," ISO/IEC JTC1/SC29/WG11/ Document m27370, Jan. 2013, 16 pp.

Menzer, et al., "Investigations on modeling BRIR tails with filtered and coherence-matched noise," Audio Engineering Society, Oct. 9-12, 2009, 9 pp.

Menzies, "Nearfiled Synthesis of Complex Sources with High-Order Ambisonics, and Binaural Rendering," Proceedings of the 13th International Conference on Auditory Display, Jun. 26-29, 2007, 8 pp.

Stewart, "Spatial Auditory Display for Acoustics and Music Collections," School of Electronic Engineering and Computer Science, Jul. 2010, 185 pp.

Vesa, et al., "Segmentation and Analysis of Early Reflections from a Binaural Room Impulse Response," Technical Report TKK-ME-R-1, TKK Reports in Media Technolog, Jan. 1, 2009, 10 pp.

Wiggins, et al., "The analysis of multi-channel sound reproduction algorithms using HRTF data," AES 19th International Conference, Jun. 2001, 13 pp.

International Search Report and Written Opinion from International Application No. PCT/US2014/039848, dated Sep. 25, 2014, 15 pp.

Response to Written Opinion dated Sep. 25, 2014, from International Application No. PCT/US2014/039848, filed on Mar. 24, 2015, 9 pp.

Written Opinion of the International Preliminary Examining Authority from International Application No. PCT/US2014/039848, dated Apr. 30, 2015, 6 pp.

Response to Written Opinion dated Apr. 30, 2015, from International Application No. PCT/US2014/039848, filed on Jun. 25, 2015, 40 pp.

Written Opinion of the International Preliminary Examining Authority from International Application No. PCT/US2014/039848, dated May 6, 2015, 6 pp.

Written Opinion of the International Preliminary Examining Authority from International Application No. PCT/US2014/039848, dated Jul. 10, 2015, 5 pp.

International Preliminary Report on Patentability from International Application No. PCT/US2014/039848, dated Sep. 2, 2015, 10 pp.

Gerzon, et al., "Ambisonic Decoders for HDTV," Audio Engineering Society, Mar. 24-27, 1992, 42 pp.

Peters, et al., "Description of Qualcomm's HoA coding technology", MPEG Meeting; Jul. 2013; Vienna; (Motion Picture Expert Group or ISO/IEC JTC1/SC29/WG11), No. m29986, XP030058515, 3 pp.

"Call for Proposals for 3D Audio," ISO/IEC JTC1/SC29/WG11/N13411, Jan. 2013, 20 pp.

Heere, et al., "MPEG-H 3D Audio—The New Standard for Coding of Immersive Spatial Audio," IEE Journal of Selected Topics in Signal Processing, vol. 5, No. 5, Aug. 15, pp. 770-779.

(56) References Cited

OTHER PUBLICATIONS

Poletti, "Three-Dimensional Surround Sound Systems Based on Spherical Harmonics," J. Audio Eng. Soc., vol. 53, No. 11, Nov. 2005, pp. 1004-1025.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D Audio," ISO/IEC JTC 1/SC 29N, Jul. 25, 2005, 311 pp.

* cited by examiner

FILTERING WITH BINAURAL ROOM IMPULSE RESPONSES

PRIORITY CLAIM

This application claims the benefit of U.S. Provisional Patent Application No. 61/828,620, filed May 29, 2013, U.S. Provisional Patent Application No. 61/847,543, filed Jul. 17, 2013, U.S. Provisional Application No. 61/886,593, filed Oct. 3, 2013, and U.S. Provisional Application No. 61/886,620, filed Oct. 3, 2013.

TECHNICAL FIELD

This disclosure relates to audio rendering and, more specifically, binaural rendering of audio data.

SUMMARY

In general, techniques are described for binaural audio rendering through application of binaural room impulse response (BRIR) filters to source audio streams.

As one example, a method of binaural audio rendering comprises determining a plurality of segments for each of a plurality of binaural room impulse response filters, wherein each the plurality of binaural room impulse response filters comprises a residual room response segment and at least one direction-dependent segment for which a filter response depends on a location within the sound field, transforming each of at least one direction-dependent segment of the plurality of binaural room impulse response filters to a domain corresponding to a domain of a plurality of hierarchical elements to generate a plurality of transformed binaural room impulse response filters, wherein the plurality of hierarchical elements describe a sound field, and performing a fast convolution of the plurality of transformed binaural room impulse response filters and the plurality of hierarchical elements to render the sound field.

In another example, a device comprises one or more processors configured to determine a plurality of segments for each of a plurality of binaural room impulse response filters, wherein each the plurality of binaural room impulse response filters comprises a residual room response segment and at least one direction-dependent segment for which a filter response depends on a location within the sound field, transform each of at least one direction-dependent segment of the plurality of binaural room impulse response filters to a domain corresponding to a domain of a plurality of hierarchical elements to generate a plurality of transformed binaural room impulse response filters, wherein the plurality of hierarchical elements describe a sound field, and perform a fast convolution of the plurality of transformed binaural room impulse response filters and the plurality of hierarchical elements to render the sound field.

In another example, an apparatus comprises means for determining a plurality of segments for each of a plurality of binaural room impulse response filters, wherein each the plurality of binaural room impulse response filters comprises a residual room response segment and at least one direction-dependent segment for which a filter response depends on a location within the sound field, means for transforming each of at least one direction-dependent segment of the plurality of binaural room impulse response filters to a domain corresponding to a domain of a plurality of hierarchical elements to generate a plurality of transformed binaural room impulse response filters, wherein the plurality of hierarchical elements describe a sound field, and means for performing a fast convolution of the plurality of transformed binaural room impulse response filters and the plurality of hierarchical elements to render the sound field.

In another example, a non-transitory computer-readable storage medium has stored thereon instructions that, when executed, cause one or more processors to determine a plurality of segments for each of a plurality of binaural room impulse response filters, wherein each the plurality of binaural room impulse response filters comprises a residual room response segment and at least one direction-dependent segment for which a filter response depends on a location within the sound field, transform each of at least one direction-dependent segment of the plurality of binaural room impulse response filters to a domain corresponding to a domain of a plurality of hierarchical elements to generate a plurality of transformed binaural room impulse response filters, wherein the plurality of hierarchical elements describe a sound field, and perform a fast convolution of the plurality of transformed binaural room impulse response filters and the plurality of hierarchical elements to render the sound field.

The details of one or more aspects of the techniques are set forth in the accompanying drawings and the description below. Other features, objects, and advantages of these techniques will be apparent from the description and drawings, and from the claims.

BRIEF DESCRIPTION OF THE DRAWINGS

Like reference characters denote like elements throughout the figures and text.

DETAILED DESCRIPTION

Figure 1:
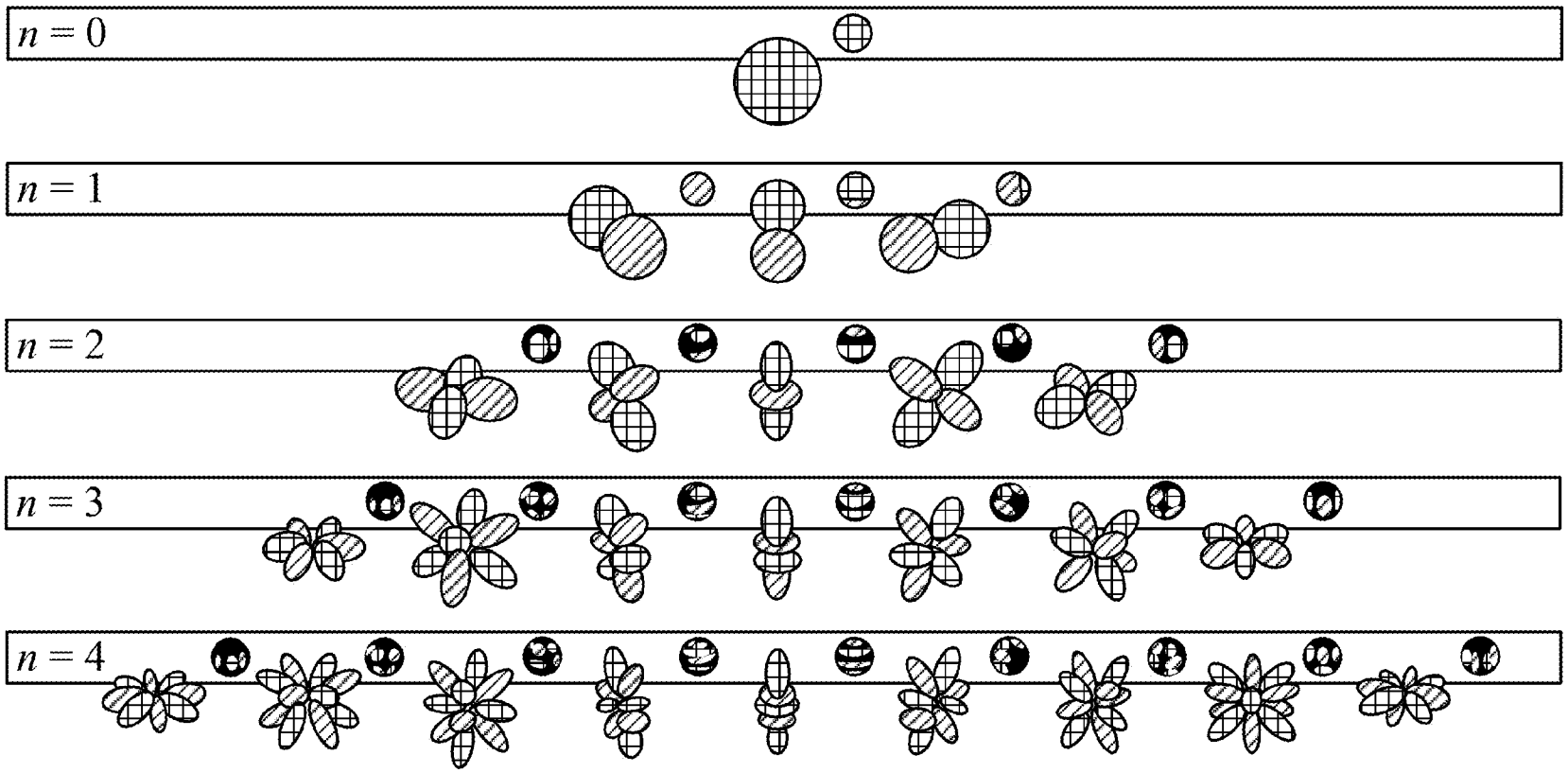
FIGS. 1 and 2 are diagrams illustrating spherical harmonic basis functions of various orders and sub-orders.

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the upcoming 22.2 format (e.g., for use with the Ultra High Definition Television standard). Another example of spatial audio format are the Spherical Harmonic coefficients (also known as Higher Order Ambisonics).

The input to a future standardized audio-encoder (a device which converts PCM audio representations to an bitstream—conserving the number of bits required per time sample) could optionally be one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using spherical harmonic coefficients (SHC)—where the coefficients represent 'weights' of a linear summation of spherical harmonic basis functions. The SHC, in this context, may include Higher Order Ambisonics (HoA) signals according to an HoA model. Spherical harmonic coefficients may alternatively or additionally include planar models and spherical models.

There are various 'surround-sound' formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, standard committees have been considering ways in which to provide an encoding into a standardized bitstream and a subsequent decoding that is adaptable and agnostic to the speaker geometry and acoustic conditions at the location of the renderer.

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed.

One example of a hierarchical set of elements is a set of spherical harmonic coefficients (SHC). The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r, \theta_r, \phi_r\}$ (which are expressed in spherical coordinates relative to the microphone capturing the sound field in this example) of the sound field can be represented uniquely by the SHC $A_n^m(k)$. Here, $$k = \frac{\omega}{c},$$

c is the speed of sound (~343 m/s), $\{r_r, \theta_r, \phi_r\}$ is a point of reference (or observation point), $j_n(\bullet)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$ which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

Figure 2:
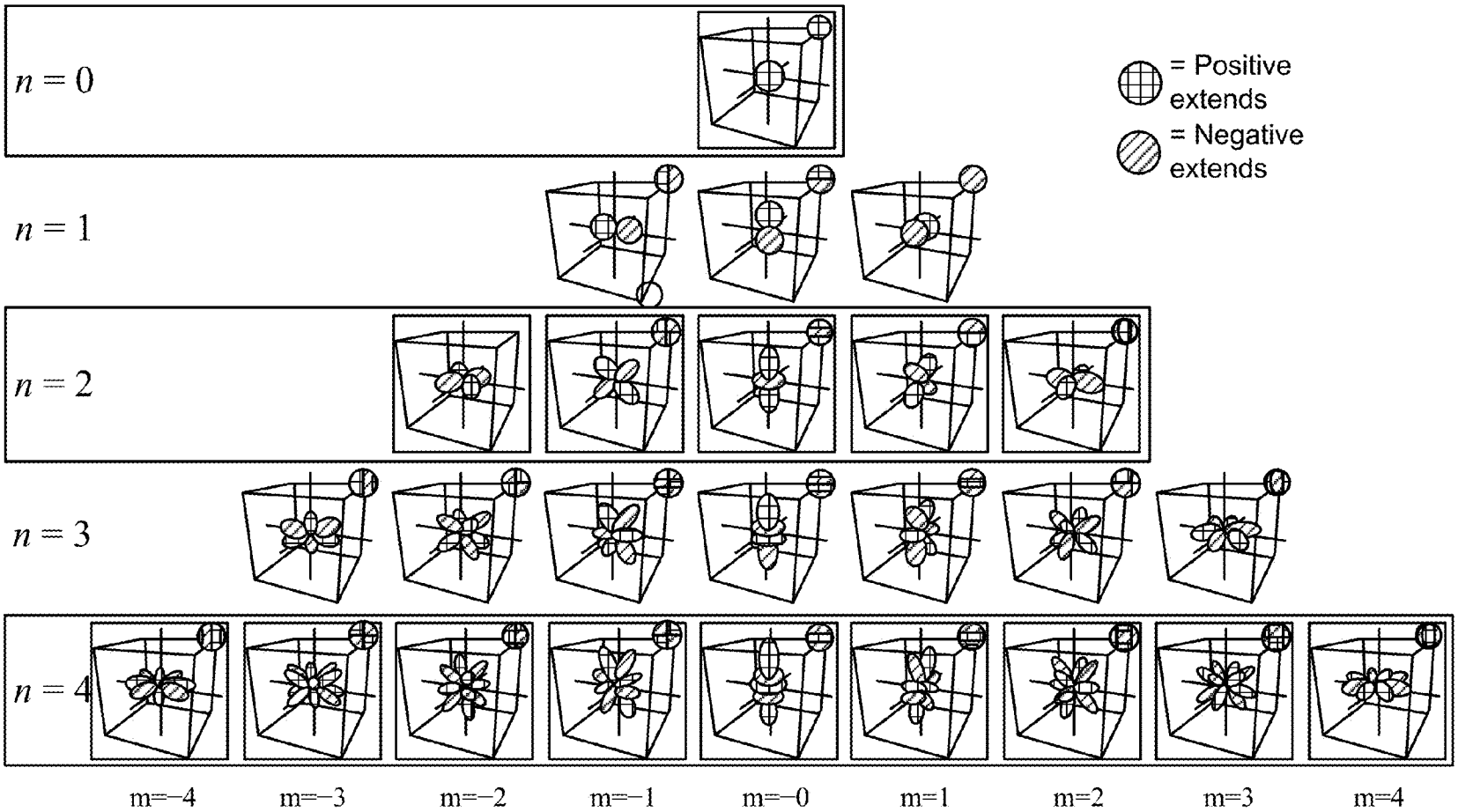

FIG. 2 is another diagram illustrating spherical harmonic basis functions from the zero order (n=0) to the fourth order (n=4). In FIG. 2, the spherical harmonic basis functions are shown in three-dimensional coordinate space with both the order and the suborder shown.

In any event, the SHC $A_n^m(k)$ can either be physically acquired (e.g., recorded) by various microphone array configurations or, alternatively, they can be derived from channel-based or object-based descriptions of the sound field. The SHC represents scene-based audio. For example, a fourth-order SHC representation involves $(1+4)^2=25$ coefficients per time sample.

To illustrate how these SHCs may be derived from an object-based description, consider the following equation. The coefficients $A_n^m(k)$ for the sound field corresponding to an individual audio object may be expressed as:

$$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\bullet)$ is the spherical Hankel function (of the second kind) of order n, and $\{r_s, \theta_s, \phi_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r, \theta_r, \phi_r\}$.

The SHCs may also be derived from a microphone-array recording as follows:

$$a_n^m(t)=b_n(r_i,t)*\langle Y_n^m(\theta_i,\phi_i),m_i(t)\rangle$$

where, $a_n^m(t)$ are the time-domain equivalent of $A_n^m(k)$ (the SHC), the * represents a convolution operation, the <,> represents an inner product, $b_n(r_i, t)$ represents a time-domain filter function dependent on $r_i$, $m_i(t)$ are the $i^{th}$ microphone signal, where the $i^{th}$ microphone transducer is located at radius $r_i$, elevation angle $\theta_i$ and azimuth angle $\phi_i$. Thus, if there are 32 transducers in the microphone array and each microphone is positioned on a sphere such that, $r_i$=a, is a constant (such as those on an Eigenmike EM32 device from mhAcoustics), the 25 SHCs may be derived using a matrix operation as follows:

$$\begin{bmatrix} a_0^0(t) \\ a_1^{-1}(t) \\ \vdots \\ a_4^4(t) \end{bmatrix} = \begin{bmatrix} b_0(a, t) \\ b_1(a, t) \\ \vdots \\ b_4(a, t) \end{bmatrix} * \begin{bmatrix} Y_0^0(\theta_1, \varphi_1) & Y_0^0(\theta_2, \varphi_2) & \dots & Y_0^0(\theta_{32}, \varphi_{32}) \\ Y_1^{-1}(\theta_1, \varphi_1) & Y_1^{-1}(\theta_2, \varphi_2) & \dots & Y_1^{-1}(\theta_{32}, \varphi_{32}) \\ \vdots & \vdots & \ddots & \vdots \\ Y_4^4(\theta_1, \varphi_1) & Y_4^4(\theta_2, \varphi_2) & \dots & Y_4^4(\theta_{32}, \varphi_{32}) \end{bmatrix} \begin{bmatrix} m_1(a, t) \\ m_2(a, t) \\ \vdots \\ m_{32}(a, t) \end{bmatrix}.$$

The matrix in the above equation may be more generally referred to as $E_s(\theta, \phi)$, where the subscript s may indicate that the matrix is for a certain transducer geometry-set, s. The convolution in the above equation (indicated by the *), is on a row-by-row basis, such that, for example, the output $a_0^0(t)$ is the result of the convolution between $b_0(a, t)$ and the time series that results from the vector multiplication of the first row of the $E_s(\theta, \phi)$ matrix, and the column of microphone signals (which varies as a function of time—accounting for the fact that the result of the vector multiplication is a time series). The computation may be most accurate when the transducer positions of the microphone array are in the so called T-design geometries (which is very close to the Eigenmike transducer geometry). One characteristic of the T-design geometry may be that the $E_s(\theta, \phi)$ matrix that results from the geometry, has a very well behaved inverse (or pseudo inverse) and further that the inverse may often be very well approximated by the transpose of the matrix, $E_s(\theta, \phi)$. If the filtering operation with $b_n(a, t)$ were to be ignored, this property would allow the recovery of the microphone signals from the SHC (i.e., $[m_i(t)]=[E_s(\theta, \phi)]^{-1}[SHC]$ in this example). The remaining figures are described below in the context of object-based and SHC-based audio-coding.

Figure 3:
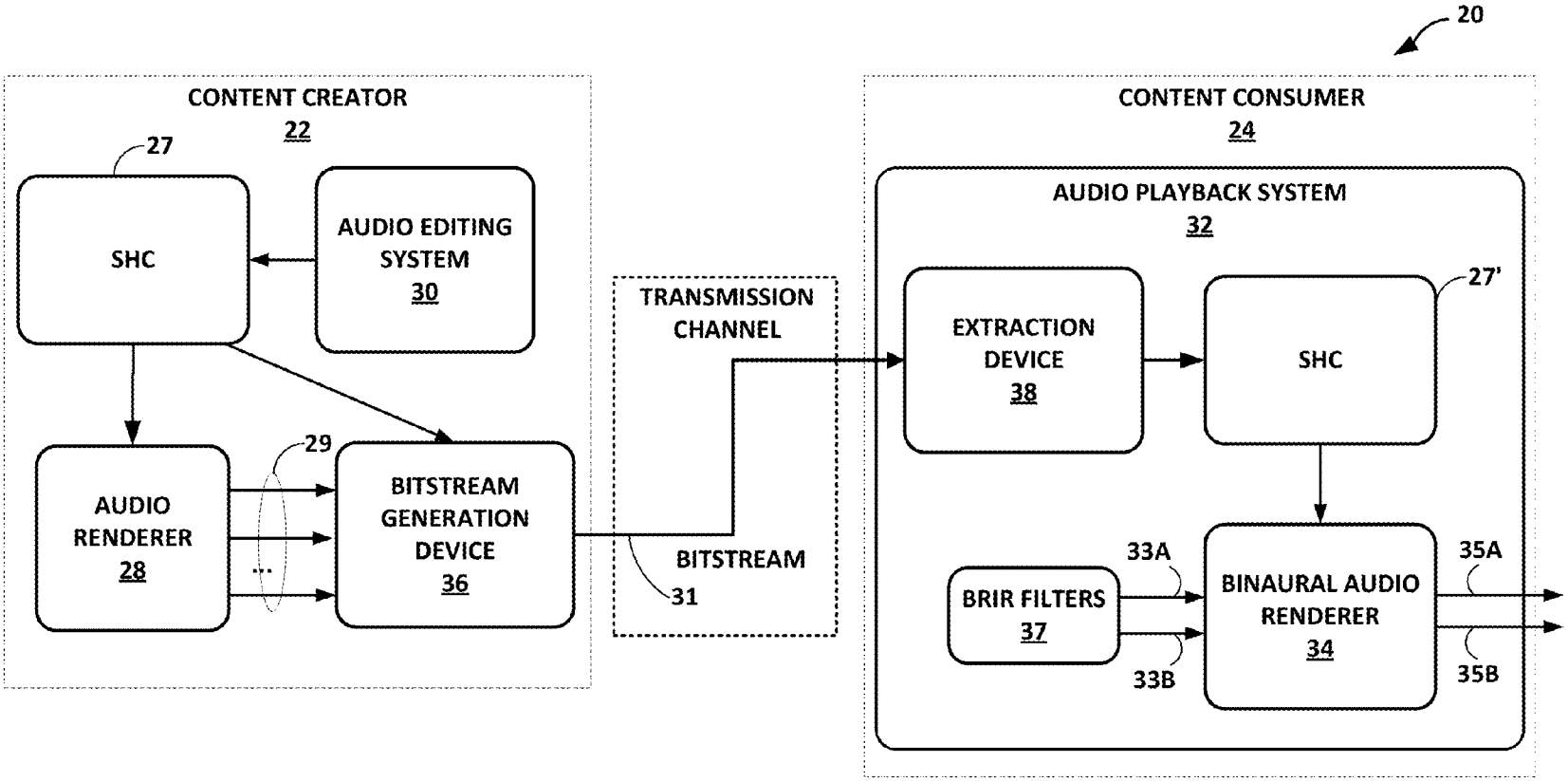
FIG. 3 is a diagram illustrating a system that may perform techniques described in this disclosure to more efficiently render audio signal information.

FIG. 3 is a diagram illustrating a system 20 that may perform techniques described in this disclosure to more efficiently render audio signal information. As shown in the example of FIG. 3, the system 20 includes a content creator 22 and a content consumer 24. While described in the context of the content creator 22 and the content consumer 24, the techniques may be implemented in any context that makes use of SHCs or any other hierarchical elements that define a hierarchical representation of a sound field.

The content creator 22 may represent a movie studio or other entity that may generate multi-channel audio content for consumption by content consumers, such as the content consumer 24. Often, this content creator generates audio content in conjunction with video content. The content consumer 24 may represent an individual that owns or has access to an audio playback system, which may refer to any form of audio playback system capable of playing back multi-channel audio content. In the example of FIG. 3, the content consumer 24 owns or has access to audio playback system 32 for rendering hierarchical elements that define a hierarchical representation of a sound field.

The content creator 22 includes an audio renderer 28 and an audio editing system 30. The audio renderer 28 may represent an audio processing unit that renders or otherwise generates speaker feeds (which may also be referred to as "loudspeaker feeds," "speaker signals," or "loudspeaker signals"). Each speaker feed may correspond to a speaker feed that reproduces sound for a particular channel of a multi-channel audio system or to a virtual loudspeaker feed that are intended for convolution with a head-related transfer function (HRTF) filters matching the speaker position. Each speaker feed may correspond to a channel of spherical harmonic coefficients (where a channel may be denoted by an order and/or suborder of associated spherical basis functions to which the spherical harmonic coefficients correspond), which uses multiple channels of SHCs to represent a directional sound field.

In the example of FIG. 3, the audio renderer 28 may render speaker feeds for conventional 5.1, 7.1 or 22.2 surround sound formats, generating a speaker feed for each of the 5, 7 or 22 speakers in the 5.1, 7.1 or 22.2 surround sound speaker systems. Alternatively, the audio renderer 28 may be configured to render speaker feeds from source spherical harmonic coefficients for any speaker configuration having any number of speakers, given the properties of source spherical harmonic coefficients discussed above. The audio renderer 28 may, in this manner, generate a number of speaker feeds, which are denoted in FIG. 3 as speaker feeds 29.

The content creator may, during the editing process, render spherical harmonic coefficients 27 ("SHCs 27"), listening to the rendered speaker feeds in an attempt to identify aspects of the sound field that do not have high fidelity or that do not provide a convincing surround sound experience. The content creator 22 may then edit source spherical harmonic coefficients (often indirectly through manipulation of different objects from which the source spherical harmonic coefficients may be derived in the manner described above). The content creator 22 may employ the audio editing system 30 to edit the spherical harmonic coefficients 27. The audio editing system 30 represents any system capable of editing audio data and outputting this audio data as one or more source spherical harmonic coefficients.

When the editing process is complete, the content creator 22 may generate bitstream 31 based on the spherical harmonic coefficients 27. That is, the content creator 22 includes a bitstream generation device 36, which may represent any device capable of generating the bitstream 31. In some instances, the bitstream generation device 36 may represent an encoder that bandwidth compresses (through, as one example, entropy encoding) the spherical harmonic coefficients 27 and that arranges the entropy encoded version of the spherical harmonic coefficients 27 in an accepted format to form the bitstream 31. In other instances, the bitstream generation device 36 may represent an audio encoder (possibly, one that complies with a known audio coding standard, such as MPEG surround, or a derivative thereof) that encodes the multi-channel audio content 29 using, as one example, processes similar to those of conventional audio surround sound encoding processes to compress the multi-channel audio content or derivatives thereof. The compressed multi-channel audio content 29 may then be entropy encoded or coded in some other way to bandwidth compress the content 29 and arranged in accordance with an agreed upon format to form the bitstream 31. Whether directly compressed to form the bitstream 31 or rendered and then compressed to form the bitstream 31, the content creator 22 may transmit the bitstream 31 to the content consumer 24.

While shown in FIG. 3 as being directly transmitted to the content consumer 24, the content creator 22 may output the bitstream 31 to an intermediate device positioned between the content creator 22 and the content consumer 24. This intermediate device may store the bitstream 31 for later delivery to the content consumer 24, which may request this bitstream. The intermediate device may comprise a file server, a web server, a desktop computer, a laptop computer, a tablet computer, a mobile phone, a smart phone, or any other device capable of storing the bitstream 31 for later retrieval by an audio decoder. This intermediate device may reside in a content delivery network capable of streaming the bitstream 31 (and possibly in conjunction with transmitting a corresponding video data bitstream) to subscribers, such as the content consumer 24, requesting the bitstream 31. Alternatively, the content creator 22 may store the bitstream 31 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 3.

As further shown in the example of FIG. 3, the content consumer 24 owns or otherwise has access to the audio playback system 32. The audio playback system 32 may represent any audio playback system capable of playing back multi-channel audio data. The audio playback system 32 includes a binaural audio renderer 34 that renders SHCs 27' for output as binaural speaker feeds 35A-35B (collectively, "speaker feeds 35"). Binaural audio renderer 34 may provide for different forms of rendering, such as one or more of the various ways of performing vector-base amplitude panning (VBAP), and/or one or more of the various ways of performing sound field synthesis.

The audio playback system 32 may further include an extraction device 38. The extraction device 38 may represent any device capable of extracting spherical harmonic coefficients 27' ("SHCs 27'," which may represent a modified form of or a duplicate of spherical harmonic coefficients 27) through a process that may generally be reciprocal to that of the bitstream generation device 36. In any event, the audio playback system 32 may receive the spherical harmonic coefficients 27' and uses binaural audio renderer 34 to render spherical harmonic coefficients 27' and thereby generate speaker feeds 35 (corresponding to the number of loudspeakers electrically or possibly wirelessly coupled to the audio playback system 32, which are not shown in the example of FIG. 3 for ease of illustration purposes). The number of speaker feeds 35 may be two, and audio playback system may wirelessly couple to a pair of headphones that includes the two corresponding loudspeakers. However, in various instances binaural audio renderer 34 may output more or fewer speaker feeds than is illustrated and primarily described with respect to FIG. 3.

Binary room impulse response (BRIR) filters 37 of audio playback system that each represents a response at a location to an impulse generated at an impulse location. BRIR filters 37 are "binaural" in that they are each generated to be representative of the impulse response as would be experienced by a human ear at the location. Accordingly, BRIR filters for an impulse are often generated and used for sound rendering in pairs, with one element of the pair for the left ear and another for the right ear. In the illustrated example, binaural audio renderer 34 uses left BRIR filters 33A and right BRIR filters 33B to render respective binaural audio outputs 35A and 35B.

For example, BRIR filters 37 may be generated by convolving a sound source signal with head-related transfer functions (HRTFs) measured as impulses responses (IRs). The impulse location corresponding to each of the BRIR filters 37 may represent a position of a virtual loudspeaker in a virtual space. In some examples, binaural audio renderer 34 convolves SHCs 27' with BRIR filters 37 corresponding to the virtual loudspeakers, then accumulates (i.e., sums) the resulting convolutions to render the sound field defined by SHCs 27' for output as speaker feeds 35. As described herein, binaural audio renderer 34 may apply techniques for reducing rendering computation by manipulating BRIR filters 37 while rendering SHCs 27' as speaker feeds 35.

In some instances, the techniques include segmenting BRIR filters 37 into a number of segments that represent different stages of an impulse response at a location within a room. These segments correspond to different physical phenomena that generate the pressure (or lack thereof) at any point on the sound field. For example, because each of BRIR filters 37 is timed coincident with the impulse, the first or "initial" segment may represent a time until the pressure wave from the impulse location reaches the location at which the impulse response is measured. With the exception of the timing information, BRIR filters 37 values for respective initial segments may be insignificant and may be excluded from a convolution with the hierarchical elements that describe the sound field. Similarly, each of BRIR filters 37 may include a last or "tail" segment that include impulse response signals attenuated to below the dynamic range of human hearing or attenuated to below a designated threshold, for instance. BRIR filters 37 values for respective tails segments may also be insignificant and may be excluded from a convolution with the hierarchical elements that describe the sound field. In some examples, the techniques may include determining a tail segment by performing a Schroeder backward integration with a designated threshold and discarding elements from the tail segment where backward integration exceeds the designated threshold. In some examples, the designated threshold is −60 dB for reverberation time $RT_{60}$.

An additional segment of each of BRIR filters 37 may represent the impulse response caused by the impulse-generated pressure wave without the inclusion of echo effects from the room. These segments may be represented and described as a head-related transfer functions (HRTFs) for BRIR filters 37, where HRTFs capture the impulse response due to the diffraction and reflection of pressure waves about the head, shoulders/torso, and outer ear as the pressure wave travels toward the ear drum. HRTF impulse responses are the result of a linear and time-invariant system (LTI) and may be modeled as minimum-phase filters. The techniques to reduce HRTF segment computation during rendering may, in some examples, include minimum-phase reconstruction and using infinite impulse response (IIR) filters to reduce an order of the original finite impulse response (FIR) filter (e.g., the HRTF filter segment).

Minimum-phase filters implemented as IIR filters may be used to approximate the HRTF filters for BRIR filters 37 with a reduced filter order. Reducing the order leads to a concomitant reduction in the number of calculations for a time-step in the frequency domain. In addition, the residual/excess filter resulting from the construction of minimum-phase filters may be used to estimate the interaural time difference (ITD) that represents the time or phase distance caused by the distance a sound pressure wave travels from a source to each ear. The ITD can then be used to model sound localization for one or both ears after computing a convolution of one or more BRIR filters 37 with the hierarchical elements that describe the sound field (i.e., determine binauralization).

A still further segment of each of BRIR filters 37 is subsequent to the HRTF segment and may account for effects of the room on the impulse response. This room segment may be further decomposed into an early echoes (or "early reflection") segment and a late reverberation segment (that is, early echoes and late reverberation may each be represented by separate segments of each of BRIR filters 37). Where HRTF data is available for BRIR filters 37, onset of the early echo segment may be identified by deconvoluting the BRIR filters 37 with the HRTF to identify the HRTF segment. Subsequent to the HRTF segment is the early echo segment. Unlike the residual room response, the HRTF and early echo segments are direction-dependent in that location of the corresponding virtual speaker determines the signal in a significant respect.

In some examples, binaural audio renderer 34 uses BRIR filters 37 prepared for the spherical harmonics domain (θ, ϕ) or other domain for the hierarchical elements that describe the sound field. That is, BRIR filters 37 may be defined in the spherical harmonics domain (SHD) as transformed BRIR filters 37 to allow binaural audio renderer 34 to perform fast convolution while taking advantage of certain properties of the data set, including the symmetry of BRIR filters 37 (e.g. left/right) and of SHCs 27'. In such examples, transformed BRIR filters 37 may be generated by multiplying (or convolving in the time-domain) the SHC rendering matrix and the original BRIR filters. Mathematically, this can be expressed according to the following equations (1)-(5):

$$BRIR'_{(N+1)^2,L,left} = SHC_{(N+1)^2,L} * BRIR_{L,left} \tag{1}$$

$$BRIR'_{(N+1)^2,L,right} = SHC_{(N+1)^2,L} * BRIR_{L,right} \tag{2}$$

or $$BRIR'_{(N+1)^2,L,right} = \begin{bmatrix} Y_0^0(\theta_1,\varphi_1) & Y_0^0(\theta_2,\varphi_2) & \dots & Y_0^0(\theta_L,\varphi_L) \\ Y_1^{-1}(\theta_1,\varphi_1) & Y_1^{-1}(\theta_2,\varphi_2) & \dots & Y_1^{-1}(\theta_L,\varphi_L) \\ \vdots & \vdots & \ddots & \vdots \\ Y_4^4(\theta_1,\varphi_1) & Y_4^4(\theta_2,\varphi_2) & \dots & Y_4^4(\theta_L,\varphi_L) \end{bmatrix} \begin{bmatrix} B_0 \\ B_1 \\ \vdots \\ B_4 \end{bmatrix} \tag{3}$$

$$BRIR''_{(N+1)^2,left} = \sum_{k=0}^{L-1} \left[ BRIR'_{(N+1)^2,k,left} \right] \tag{4}$$

$$BRIR''_{(N+1)^2,right} = \sum_{k=0}^{L-1} \left[ BRIR'_{(N+1)^2,k,right} \right] \tag{5}$$

Here, (3) depicts either (1) or (2) in matrix form for fourth-order spherical harmonic coefficients (which may be an alternative way to refer to those of the spherical harmonic coefficients associated with spherical basis functions of the fourth-order or less). Equation (3) may of course be modified for higher- or lower-order spherical harmonic coefficients. Equations (4)-(5) depict the summation of the transformed left and right BRIR filters 37 over the loudspeaker dimension, L, to generate summed SHC-binaural rendering matrices (BRIR"). In combination, the summed SHC-binaural rendering matrices have dimensionality $[(N+1)^2$, Length, 2], where Length is a length of the impulse response vectors to which any combination of equations (1)-(5) may be applied. In some instances of equations (1) and (2), the rendering matrix SHC may be binauralized such that equation (1) may be modified to $BRIR'_{(N+1)^2,L,left} = SHC_{(N+1)^2,L,left} * BRIR_{L,left}$ and equation (2) may be modified to $BRIR'_{(N+1)^2,L,right} = SHC_{(N+1)^2,L} * BRIR_{L,right}$.

The SHC rendering matrix presented in the above equations (1)-(3), SHC, includes elements for each order/suborder combination of SHCs 27', which effectively define a separate SHC channel, where the element values are set for a position for the speaker, L, in the spherical harmonic domain. $BRIR_{L,left}$ represents the BRIR response at the left ear or position for an impulse produced at the location for the speaker, L, and is depicted in (3) using impulse response vectors $B_i$ for $\{i | i \in [0, L]\}$. $BRIR'_{(N+1)^2,L,left}$ represents one half of a "SHC-binaural rendering matrix," i.e., the SHC-binaural rendering matrix at the left ear or position for an impulse produced at the location for speakers, L, transformed to the spherical harmonics domain. $BRIR'_{(N+1)^2,L,right}$ represents the other half of the SHC-binaural rendering matrix.

In some examples, the techniques may include applying the SHC rendering matrix only to the HRTF and early reflection segments of respective original BRIR filters 37 to generate transformed BRIR filters 37 and an SHC-binaural rendering matrix. This may reduce a length of convolutions with SHCs 27'.

In some examples, as depicted in equations (4)-(5), the SHC-binaural rendering matrices having dimensionality that incorporates the various loudspeakers in the spherical harmonics domain may be summed to generate a $(N+1)^2$ *Length*2 filter matrix that combines SHC rendering and BRIR rendering/mixing. That is, SHC-binaural rendering matrices for each of the L loudspeakers may be combined by, e.g., summing the coefficients over the L dimension. For SHC-binaural rendering matrices of length Length, this produces a $(N+1)^2$*Length*2 summed SHC-binaural rendering matrix that may be applied to an audio signal of spherical harmonics coefficients to binauralize the signal. Length may be a length of a segment of the BRIR filters segmented in accordance with techniques described herein.

Techniques for model reduction may also be applied to the altered rendering filters, which allows SHCs 27' (e.g., the SHC contents) to be directly filtered with the new filter matrix (a summed SHC-binaural rendering matrix). Binaural audio renderer 34 may then convert to binaural audio by summing the filtered arrays to obtain the binaural output signals 35A, 35B.

In some examples, BRIR filters 37 of audio playback system 32 represent transformed BRIR filters in the spherical harmonics domain previously computed according to any one or more of the above-described techniques. In some examples, transformation of original BRIR filters 37 may be performed at run-time.

In some examples, because the BRIR filters 37 are typically symmetric, the techniques may promote further reduction of the computation of binaural outputs 35A, 35B by using only the SHC-binaural rendering matrix for either the left or right ear. When summing SHCs 27' filtered by a filter matrix, binaural audio renderer 34 may make conditional decisions for either outputs signal 35A or 35B as a second channel when rendering the final output. As described herein, reference to processing content or to modifying rendering matrices described with respect to either the left or right ear should be understood to be similarly applicable to the other ear.

In this way, the techniques may provide multiple approaches to reduce a length of BRIR filters 37 in order to potentially avoid direct convolution of the excluded BRIR filter samples with multiple channels. As a result, binaural audio renderer 34 may provide efficient rendering of binaural output signals 35A, 35B from SHCs 27'.

Figure 4:
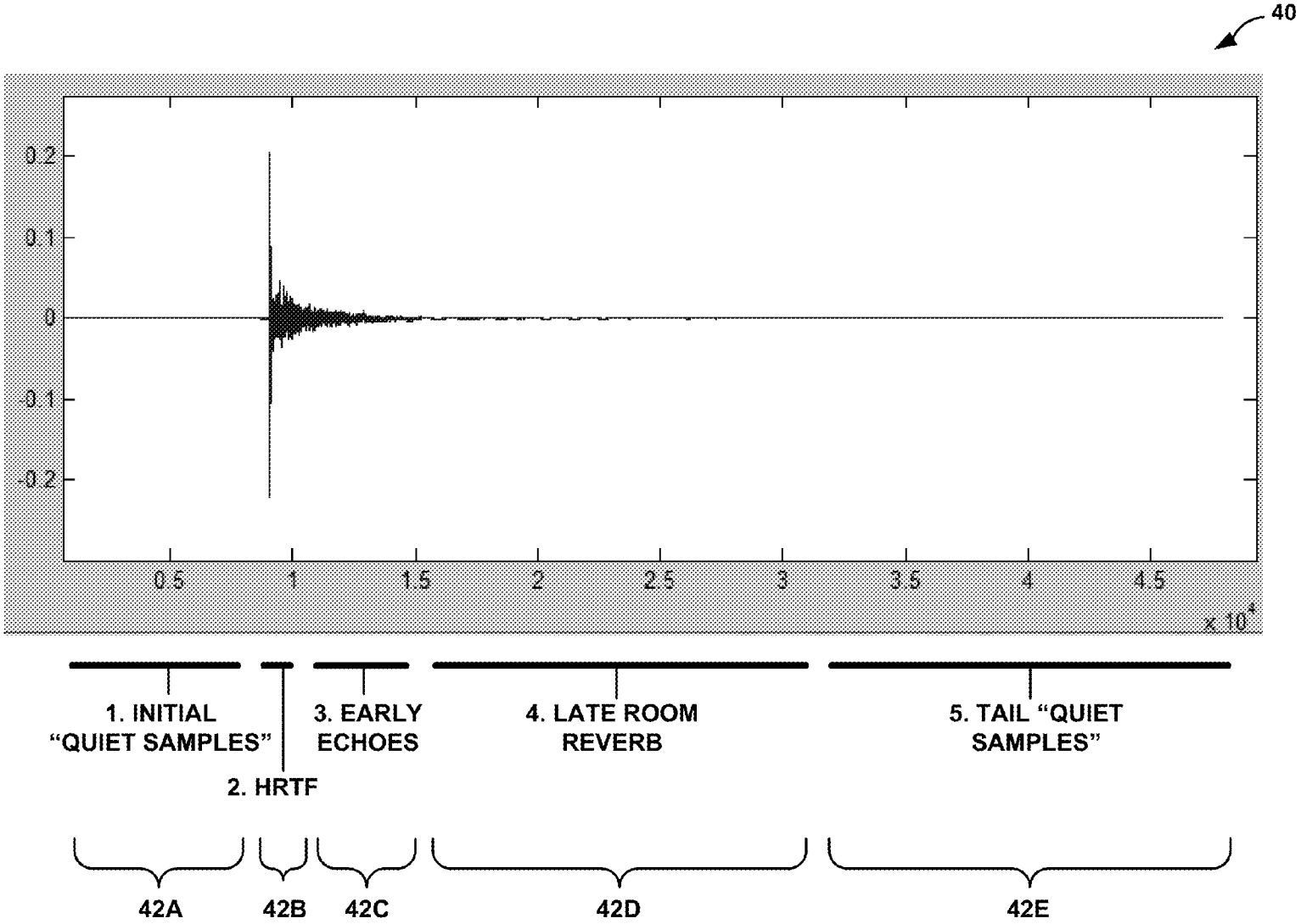
FIG. 4 is a block diagram illustrating an example binaural room impulse response (BRIR).

FIG. 4 is a block diagram illustrating an example binaural room impulse response (BRIR). BRIR 40 illustrates five segments 42A-42E. The initial segment 42A and tail segment 42E both include quiet samples that may be insignificant and excluded from rendering computation. Head-related transfer function (HRTF) segment 42B includes the impulse response due to head-related transfer and may be identified using techniques described herein. Early echoes (alternatively, "early reflections") segment 42C and late room reverb segment 42D combine the HRTF with room effects, i.e., the impulse response of early echoes segment 42C matches that of the HRTF for BRIR 40 filtered by early echoes and late reverberation of the room. Early echoes segment 42C may include more discrete echoes in comparison to late room reverb segment 42D, however. The mixing time is the time between early echoes segment 42C and late room reverb segment 42D and indicates the time at which early echoes become dense reverb. The mixing time is illustrated as occurring at approximately $1.5\times10^4$ samples into the HRTF, or approximately $7.0\times10^4$ samples from the onset of HRTF segment 42B. In some examples, the techniques include computing the mixing time using statistical data and estimation from the room volume. In some examples, the perceptual mixing time with 50% confidence internal, $t_{mp50}$, is approximately 36 milliseconds (ms) and with 95% confidence interval, $t_{mp95}$, is approximately 80 ms. In some examples, late room reverb segment 42D of a filter corresponding to BRIR 40 may be synthesized using coherence-matched noise tails.

Figure 5:
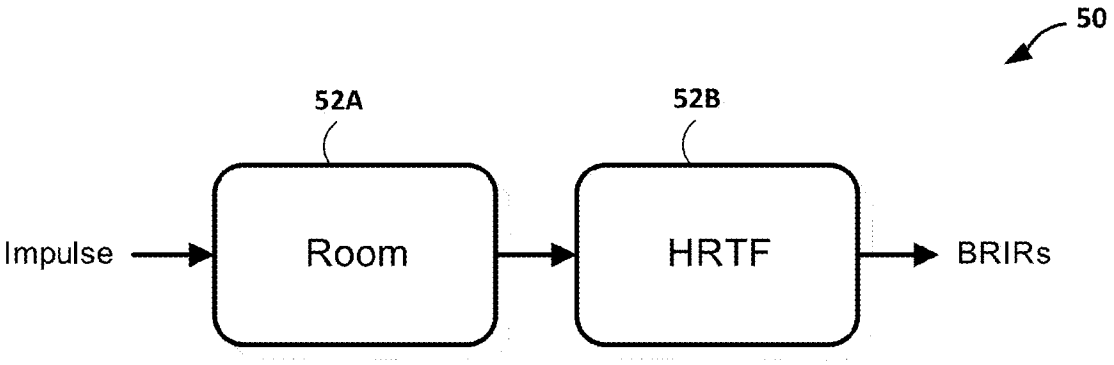
FIG. 5 is a block diagram illustrating an example systems model for producing a BRIR in a room.

FIG. 5 is a block diagram illustrating an example systems model 50 for producing a BRIR, such as BRIR 40 of FIG. 4, in a room. The model includes cascaded systems, here room 52A and HRTF 52B. After HRTF 52B is applied to an impulse, the impulse response matches that of the HRTF filtered by early echoes of the room 52A.

Figure 6:
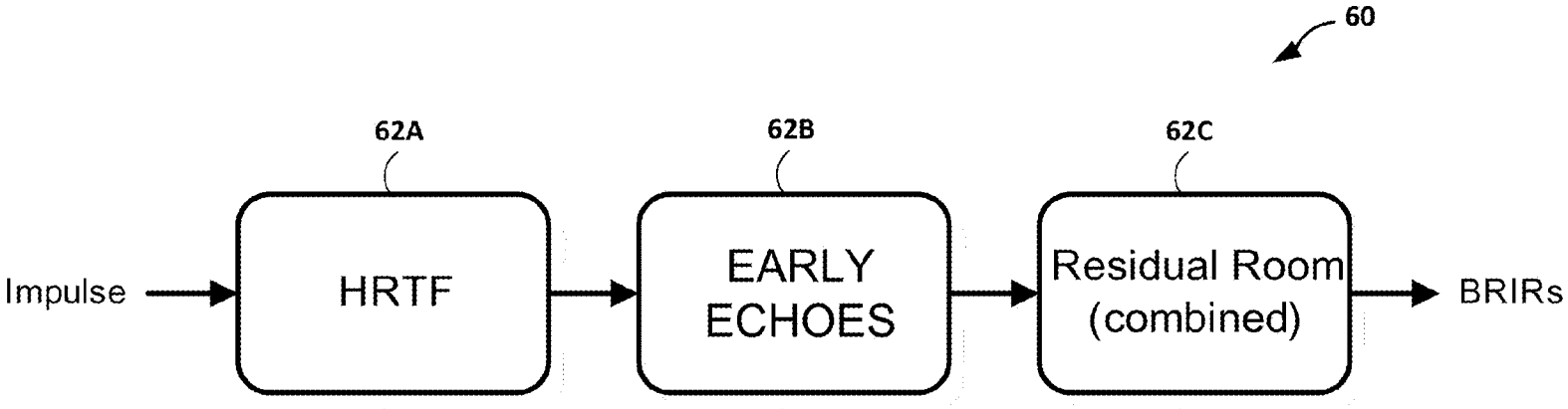
FIG. 6 is a block diagram illustrating a more in-depth systems model for producing a BRIR in a room.

FIG. 6 is a block diagram illustrating a more in-depth systems model 60 for producing a BRIR, such as BRIR 40 of FIG. 4, in a room. This model 60 also includes cascaded systems, here HRTF 62A, early echoes 62B, and residual room 62C (which combines HRTF and room echoes). Model 60 depicts the decomposition of room 52A into early echoes 62B and residual room 62C and treats each system 62A, 62B, 62C as linear-time invariant.

Early echoes 62B includes more discrete echoes than residual room 62C. Accordingly, early echoes 62B may vary per virtual speaker channel, while residual room 62C having a longer tail may be synthesized as a single stereo copy. For some measurement mannequins used to obtain a BRIR, HRTF data may be available as measured in an anechoic chamber. Early echoes 62B may be determined by deconvoluting the BRIR and the HRTF data to identify the location of early echoes (which may be referred to as "reflections"). In some examples, HRTF data is not readily available and the techniques for identifying early echoes 62B include blind estimation. However, a straightforward approach may include regarding the first few milliseconds (e.g., the first 5, 10, 15, or 20 ms) as direct impulse filtered by the HRTF. As noted above, the techniques may include computing the mixing time using statistical data and estimation from the room volume.

In some examples, the techniques may include synthesizing one or more BRIR filters for residual room 62C. After the mixing time, BRIR reverb tails (represented as system residual room 62C in FIG. 6) can be interchanged in some instances without perceptual punishments. Further, the BRIR reverb tails can be synthesized with Gaussian white noise that matches the Energy Decay Relief (EDR) and Frequency-Dependent Interaural Coherence (FDIC). In some examples, a common synthetic BRIR reverb tail may be generated for BRIR filters. In some examples, the common EDR may be an average of the EDRs of all speakers or may be the front zero degree EDR with energy matching to the average energy. In some examples, the FDIC may be an average FDIC across all speakers or may be the minimum value across all speakers for a maximally decorrelated measure for spaciousness. In some examples, reverb tails can also be simulated with artificial reverb with Feedback Delay Networks (FDN).

With a common reverb tail, the later portion of a corresponding BRIR filter may be excluded from separate convolution with each speaker feed, but instead may be applied once onto the mix of all speaker feeds. As described above, and in further detail below, the mixing of all speaker feeds can be further simplified with spherical harmonic coefficients signal rendering.

Figure 7:
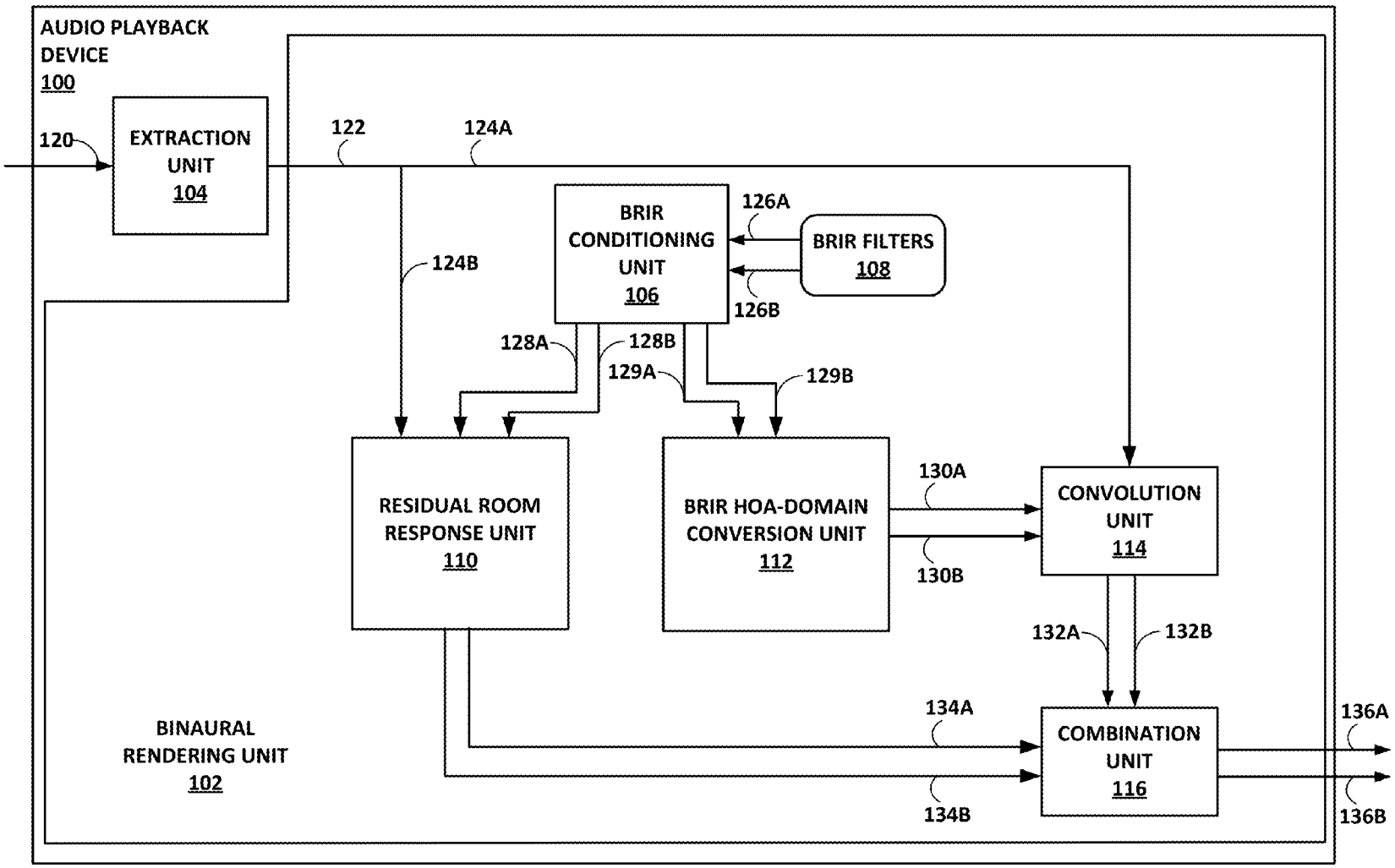
FIG. 7 is a block diagram illustrating an example of an audio playback device that may perform various aspects of the binaural audio rendering techniques described in this disclosure.

FIG. 7 is a block diagram illustrating an example of an audio playback device that may perform various aspects of the binaural audio rendering techniques described in this disclosure. While illustrated as a single device, i.e., audio playback device 100 in the example of FIG. 7, the techniques may be performed by one or more devices. Accordingly, the techniques should be not limited in this respect.

As shown in the example of FIG. 7, audio playback device 100 may include an extraction unit 104 and a binaural rendering unit 102. The extraction unit 104 may represent a unit configured to extract encoded audio data from bitstream 120. The extraction unit 104 may forward the extracted encoded audio data in the form of spherical harmonic coefficients (SHCs) 122 (which may also be referred to a higher order ambisonics (HOA) in that the SHCs 122 may include at least one coefficient associated with an order greater than one) to the binaural rendering unit 146.

In some examples, audio playback device 100 includes an audio decoding unit configured to decode the encoded audio data so as to generate the SHCs 122. The audio decoding unit may perform an audio decoding process that is in some aspects reciprocal to the audio encoding process used to encode SHCs 122. The audio decoding unit may include a time-frequency analysis unit configured to transform SHCs of encoded audio data from the time domain to the frequency domain, thereby generating the SHCs 122. That is, when the encoded audio data represents a compressed form of the SHC 122 that is not converted from the time domain to the frequency domain, the audio decoding unit may invoke the time-frequency analysis unit to convert the SHCs from the time domain to the frequency domain so as to generate SHCs 122 (specified in the frequency domain). The time-frequency analysis unit may apply any form of Fourier-based transform, including a fast Fourier transform (FFT), a discrete cosine transform (DCT), a modified discrete cosine transform (MDCT), and a discrete sine transform (DST) to provide a few examples, to transform the SHCs from the time domain to SHCs 122 in the frequency domain. In some instances, SHCs 122 may already be specified in the frequency domain in bitstream 120. In these instances, the time-frequency analysis unit may pass SHCs 122 to the binaural rendering unit 102 without applying a transform or otherwise transforming the received SHCs 122. While described with respect to SHCs 122 specified in the frequency domain, the techniques may be performed with respect to SHCs 122 specified in the time domain.

Binaural rendering unit 102 represents a unit configured to binauralize SHCs 122. Binaural rendering unit 102 may, in other words, represent a unit configured to render the SHCs 122 to a left and right channel, which may feature spatialization to model how the left and right channel would be heard by a listener in a room in which the SHCs 122 were recorded. The binaural rendering unit 102 may render SHCs 122 to generate a left channel 136A and a right channel 136B (which may collectively be referred to as "channels 136") suitable for playback via a headset, such as headphones. As shown in the example of FIG. 7, the binaural rendering unit 102 includes BRIR filters 108, a BRIR conditioning unit 106, a residual room response unit 110, a BRIR SHC-domain conversion unit 112, a convolution unit 114, and a combination unit 116.

BRIR filters 108 include one or more BRIR filters and may represent an example of BRIR filters 37 of FIG. 3. BRIR filters 108 may include separate BRIR filters 126A, 126B representing the effect of the left and right HRTF on the respective BRIRs.

BRIR conditioning unit 106 receives L instances of BRIR filters 126A, 126B, one for each virtual loudspeaker L and with each BRIR filter having length N. BRIR filters 126A, 126B may already be conditioned to remove quiet samples. BRIR conditioning unit 106 may apply techniques described above to segment BRIR filters 126A, 126B to identify respective HRTF, early reflection, and residual room segments. BRIR conditioning unit 106 provides the HRTF and early reflection segments to BRIR SHC-domain conversion unit 112 as matrices 129A, 129B representing left and right matrices of size [a, L], where a is a length of the concatenation of the HRTF and early reflection segments and L is a number of loudspeakers (virtual or real). BRIR conditioning unit 106 provides the residual room segments of BRIR filters 126A, 126B to residual room response unit 110 as left and right residual room matrices 128A, 128B of size [b, L], where b is a length of the residual room segments and L is a number of loudspeakers (virtual or real).

Residual room response unit 110 may apply techniques describe above to compute or otherwise determine left and right common residual room response segments for convolution with at least some portion of the hierarchical elements (e.g., spherical harmonic coefficients) describing the sound field, as represented in FIG. 7 by SHCs 122. That is, residual room response unit 110 may receive left and right residual room matrices 128A, 128B and combine respective left and right residual room matrices 128A, 128B over L to generate left and right common residual room response segments. Residual room response unit 110 may perform the combination by, in some instances, averaging the left and right residual room matrices 128A, 128B over L.

Residual room response unit 110 may then compute a fast convolution of the left and right common residual room response segments with at least one channel of SHCs 122, illustrated in FIG. 7 as channel(s) 124B. In some examples, because left and right common residual room response segments represent ambient, non-directional sound, channel(s) 124B is the W channel (i.e., $0^{th}$ order) of the SHCs 122 channels, which encodes the non-directional portion of a sound field. In such examples, for a W channel sample of length Length, fast convolution by residual room response unit 110 with left and right common residual room response segments produces left and right output signals 134A, 134B of length Length.

As used herein, the terms "fast convolution" and "convolution" may refer to a convolution operation in the time domain as well as to a point-wise multiplication operation in the frequency domain. In other words and as is well-known to those skilled in the art of signal processing, convolution in the time domain is equivalent to point-wise multiplication in the frequency domain, where the time and frequency domains are transforms of one another. The output transform is the point-wise product of the input transform with the transfer function. Accordingly, convolution and point-wise multiplication (or simply "multiplication") can refer to conceptually similar operations made with respect to the respective domains (time and frequency, herein). Convolution units 114, 214, 230; residual room response units 210, 354; filters 384 and reverb 386; may alternatively apply multiplication in the frequency domain, where the inputs to these components is provided in the frequency domain rather than the time domain. Other operations described herein as "fast convolution" or "convolution" may, similarly, also refer to multiplication in the frequency domain, where the inputs to these operations is provided in the frequency domain rather than the time domain.

In some examples, residual room response unit 110 may receive, from BRIR conditioning unit 106, a value for an onset time of the common residual room response segments. Residual room response unit 110 may zero-pad or otherwise delay the outputs signals 134A, 134B in anticipation of combination with earlier segments for the BRIR filters 108.

BRIR SHC-domain conversion unit 112 (hereinafter "domain conversion unit 112") applies an SHC rendering matrix to BRIR matrices to potentially convert the left and right BRIR filters 126A, 126B to the spherical harmonic domain and then to potentially sum the filters over L. Domain conversion unit 112 outputs the conversion result as left and right SHC-binaural rendering matrices 130A, 130B, respectively. Where matrices 129A, 129B are of size [a, L], each of SHC-binaural rendering matrices 130A, 130B is of size $[(N+1)^2, a]$ after summing the filters over L (see equations (4)-(5) for example). In some examples, SHC-binaural rendering matrices 130A, 130B are configured in audio playback device 100 rather than being computed at run-time or a setup-time. In some examples, multiple instances of SHC-binaural rendering matrices 130A, 130B are configured in audio playback device 100, and audio playback device 100 selects a left/right pair of the multiple instances to apply to SHCs 124A.

Convolution unit 114 convolves left and right binaural rendering matrices 130A, 130B with SHCs 124A, which may in some examples be reduced in order from the order of SHCs 122. For SHCs 124A in the frequency (e.g., SHC) domain, convolution unit 114 may compute respective point-wise multiplications of SHCs 124A with left and right binaural rendering matrices 130A, 130B. For an SHC signal of length Length, the convolution results in left and right filtered SHC channels 132A, 132B of size $[\text{Length}, (N+1)^2]$, there typically being a row for each output signals matrix for each order/sub-order combination of the spherical harmonics domain.

Combination unit 116 may combine left and right filtered SHC channels 132A, 132B with output signals 134A, 134B to produce binaural output signals 136A, 136B. Combination unit 116 may then separately sum each left and right filtered SHC channels 132A, 132B over L to produce left and right binaural output signals for the HRTF and early echoes (reflection) segments prior to combining the left and right binaural output signals with left and right output signals 134A, 134B to produce binaural output signals 136A, 136B.

Figure 8:
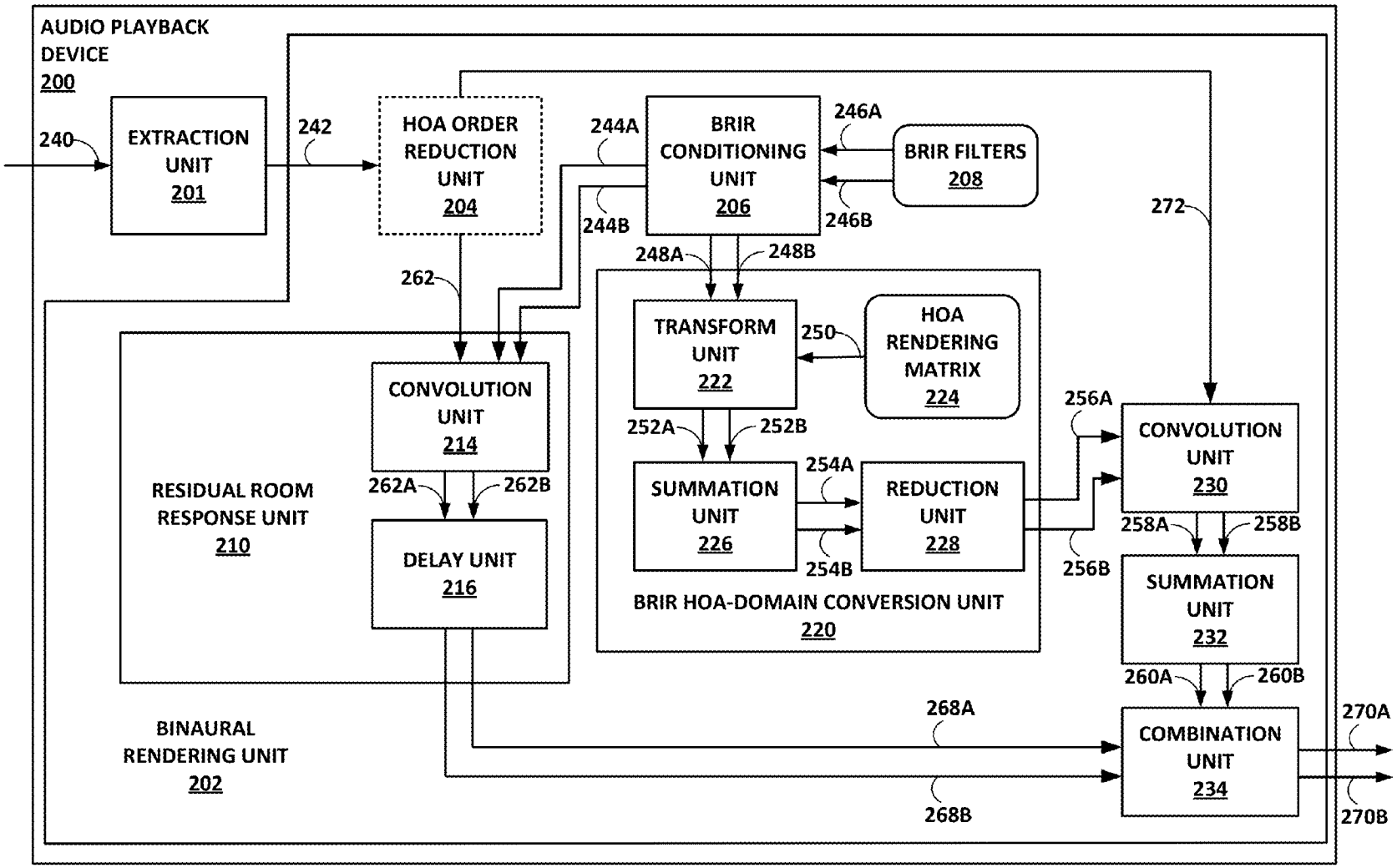
FIG. 8 is a block diagram illustrating an example of an audio playback device that may perform various aspects of the binaural audio rendering techniques described in this disclosure.

FIG. 8 is a block diagram illustrating an example of an audio playback device that may perform various aspects of the binaural audio rendering techniques described in this disclosure. Audio playback device 200 may represent an example instance of audio playback device 100 of FIG. 7 is further detail.

Audio playback device 200 may include an optional SHCs order reduction unit 204 that processes inbound SHCs 242 from bitstream 240 to reduce an order of the SHCs 242. Optional SHCs order reduction provides the highest-order (e.g., $0^{th}$ order) channel 262 of SHCs 242 (e.g., the W channel) to residual room response unit 210, and provides reduced-order SHCs 242 to convolution unit 230. In instances in which SHCs order reduction unit 204 does not reduce an order of SHCs 242, convolution unit 230 receives SHCs 272 that are identical to SHCs 242. In either case, SHCs 272 have dimensions [Length, $(N+1)^2$], where N is the order of SHCs 272.

BRIR conditioning unit 206 and BRIR filters 208 may represent example instances of BRIR conditioning unit 106 and BRIR filters 108 of FIG. 7. Convolution unit 214 of residual response unit 214 receives common left and right residual room segments 244A, 244B conditioned by BRIR condition unit 206 using techniques described above, and convolution unit 214 convolves the common left and right residual room segments 244A, 244B with highest-order channel 262 to produce left and right residual room signals 262A, 262B. Delay unit 216 may zero-pad the left and right residual room signals 262A, 262B with the onset number of samples to the common left and right residual room segments 244A, 244B to produce left and right residual room output signals 268A, 268B.

BRIR SHC-domain conversion unit 220 (hereinafter, domain conversion unit 220) may represent an example instance of domain conversion unit 112 of FIG. 7. In the illustrated example, transform unit 222 applies an SHC rendering matrix 224 of $(N+1)^2$ dimensionality to matrices 248A, 248B representing left and right matrices of size [a, L], where a is a length of the concatenation of the HRTF and early reflection segments and L is a number of loudspeakers (e.g., virtual loudspeakers). Transform unit 222 outputs left and right matrices 252A, 252B in the SHC-domain having dimensions [$(N+1)^2$, a, L]. Summation unit 226 may sum each of left and right matrices 252A, 252B over L to produce left and right intermediate SHC-rendering matrices 254A, 254B having dimensions [$(N+1)^2$, a]. Reduction unit 228 may apply techniques described above to further reduce computation complexity of applying SHC-rendering matrices to SHCs 272, such as minimum-phase reduction and using Balanced Model Truncation methods to design IIR filters to approximate the frequency response of the respective minimum phase portions of intermediate SHC-rendering matrices 254A, 254B that have had minimum-phase reduction applied. Reduction unit 228 outputs left and right SHC-rendering matrices 256A, 256B.

Convolution unit 230 filters the SHC contents in the form of SHCs 272 to produce intermediate signals 258A, 258B, which summation unit 232 sums to produce left and right signals 260A, 260B. Combination unit 234 combines left and right residual room output signals 268A, 268B and left and right signals 260A, 260B to produce left and right binaural output signals 270A, 270B.

In some examples, binaural rendering unit 202 may implement further reductions to computation by using only one of the SHC-binaural rendering matrices 252A, 252B generated by transform unit 222. As a result, convolution unit 230 may operate on just one of the left or right signals, reducing convolution operations by half. Summation unit 232, in such examples, makes conditional decisions for the second channel when rendering the outputs 260A, 260B.

Figure 9:
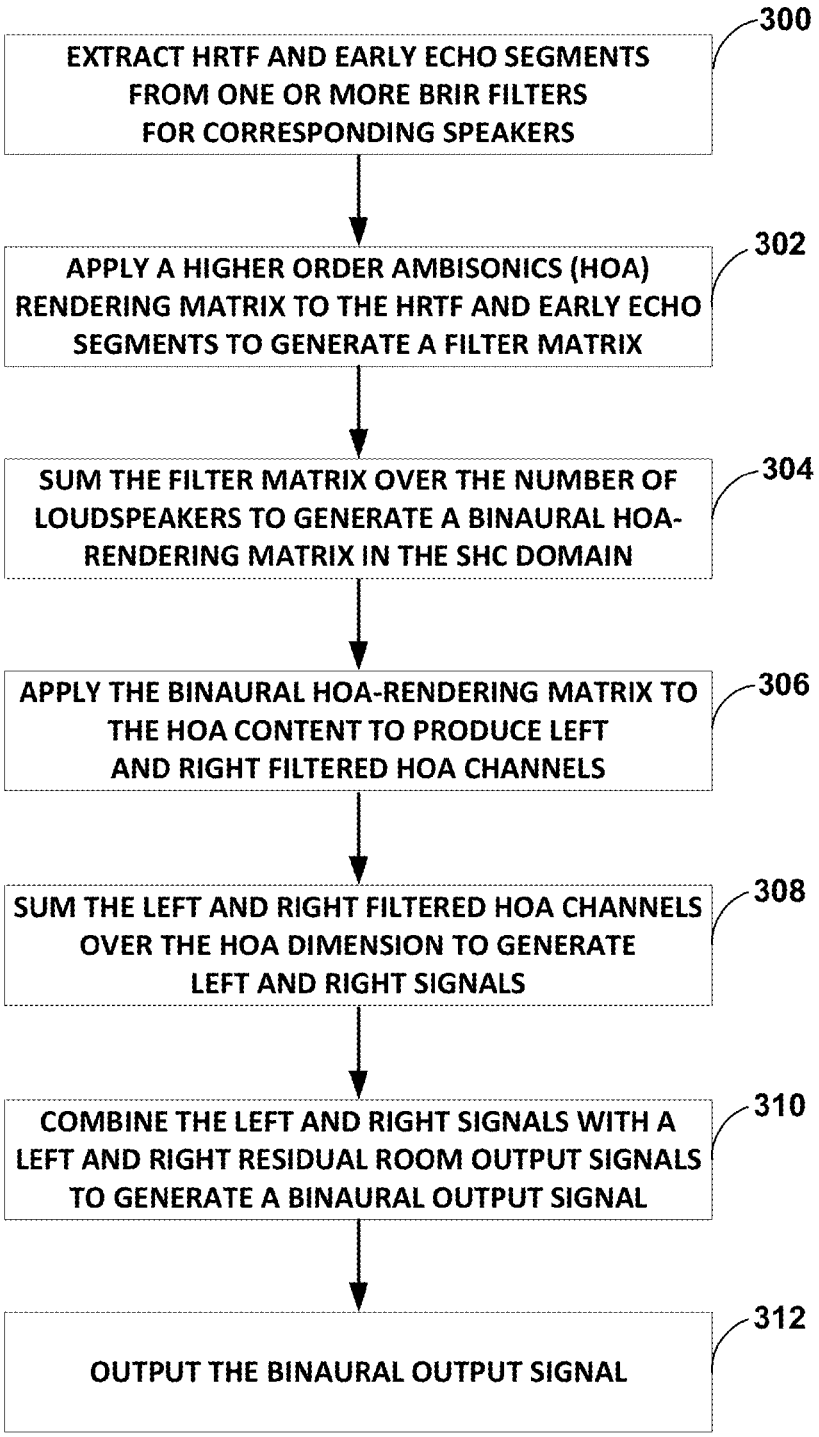
FIG. 9 is a flow diagram illustrating an example mode of operation for a binaural rendering device to render spherical harmonic coefficients according to various aspects of the techniques described in this disclosure.

FIG. 9 is a flowchart illustrating an example mode of operation for a binaural rendering device to render spherical harmonic coefficients according to techniques described in this disclosure. For illustration purposes, the example mode of operation is described with respect to audio playback device 200 of FIG. 7. Binaural room impulse response (BRIR) conditioning unit 206 conditions left and right BRIR filters 246A, 246B, respectively, by extracting direction-dependent components/segments from the BRIR filters 246A, 246B, specifically the head-related transfer function and early echoes segments (300). Each of left and right BRIR filters 126A, 126B may include BRIR filters for one or more corresponding loudspeakers. BRIR conditioning unit 106 provides a concatenation of the extracted head-related transfer function and early echoes segments to BRIR SHC-domain conversion unit 220 as left and right matrices 248A, 248B.

BRIR SHC-domain conversion unit 220 applies an HOA rendering matrix 224 to transform left and right filter matrices 248A, 248B including the extracted head-related transfer function and early echoes segments to generate left and right filter matrices 252A, 252B in the spherical harmonic (e.g., HOA) domain (302). In some examples, audio playback device 200 may be configured with left and right filter matrices 252A, 252B. In some examples, audio playback device 200 receives BRIR filters 208 in an out-of-band or in-band signal of bitstream 240, in which case audio playback device 200 generates left and right filter matrices 252A, 252B. Summation unit 226 sums the respective left and right filter matrices 252A, 252B over the loudspeaker dimension to generate a binaural rendering matrix in the SHC domain that includes left and right intermediate SHC-rendering matrices 254A, 254B (304). A reduction unit 228 may further reduce the intermediate SHC-rendering matrices 254A, 254B to generate left and right SHC-rendering matrices 256A, 256B.

A convolution unit 230 of binaural rendering unit 202 applies the left and right intermediate SHC-rendering matrices 256A, 256B to SHC content (such as spherical harmonic coefficients 272) to produce left and right filtered SHC (e.g., HOA) channels 258A, 258B (306).

Summation unit 232 sums each of the left and right filtered SHC channels 258A, 258B over the SHC dimension, $(N+1)^2$, to produce left and right signals 260A, 260B for the direction-dependent segments (308). Combination unit 116 may then combine the left and right signals 260A, 260B with left and right residual room output signals 268A, 268B to generate a binaural output signal including left and right binaural output signals 270A, 270B.

Figure 10A:
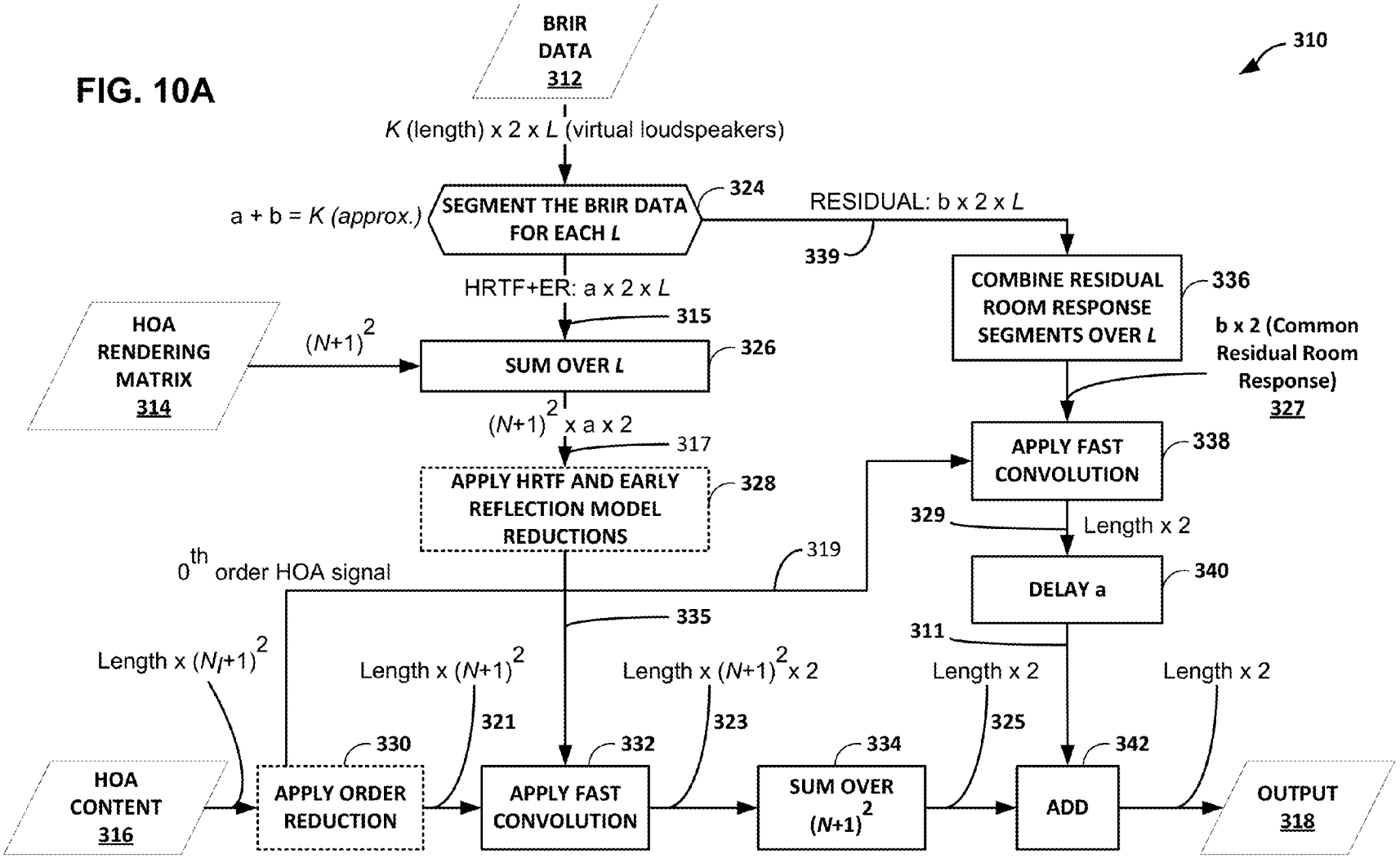
FIGS. 10A, 10B depict flow diagrams illustrating alternative modes of operation that may be performed by the audio playback devices of FIGS. 7 and 8 in accordance with various aspects of the techniques described in this disclosure.

FIG. 10A is a diagram illustrating an example mode of operation 310 that may be performed by the audio playback devices of FIGS. 7 and 8 in accordance with various aspects of the techniques described in this disclosure. Mode of operation 310 is described herein after with respect to audio playback device 200 of FIG. 8. Binaural rendering unit 202 of audio playback device 200 may be configured with BRIR data 312, which may be an example instance of BRIR filters 208, and HOA rendering matrix 314, which may be an example instance of HOA rendering matrix 224. Audio playback device 200 may receive BRIR data 312 and HOA rendering matrix 314 in an in-band or out-of-band signaling channel vis-à-vis the bitstream 240. BRIR data 312 in this example has L filters representing, for instance, L real or virtual loudspeakers, each of the L filters being length K. Each of the L filters may include left and right components ("x 2"). In some cases, each of the L filters may include a single component for left or right, which is symmetrical to its counterpart: right or left. This may reduce a cost of fast convolution.

BRIR conditioning unit 206 of audio playback device 200 may condition the BRIR data 312 by applying segmentation and combination operations. Specifically, in the example mode of operation 310, BRIR conditioning unit 206 segments each of the L filters according to techniques described herein into HRTF plus early echo segments of combined length a to produce matrix 315 (dimensionality [a, 2, L]) and into residual room response segments to produce residual matrix 339 (dimensionality [b, 2, L]) (324). The length K of the L filters of BRIR data 312 is approximately the sum of a and b. Transform unit 222 may apply HOA/SHC rendering matrix 314 of $(N+1)^2$ dimensionality to the L filters of matrix 315 to produce matrix 317 (which may be an example instance of a combination of left and right matrices 252A, 252B) of dimensionality [$(N+1)^2$, a, 2, L]. Summation unit 226 may sum each of left and right matrices 252A, 252B over L to produce intermediate SHC-rendering matrix 335 having dimensionality [$(N+1)^2$, a, 2] (the third dimension having value 2 representing left and right components; intermediate SHC-rendering matrix 335 may represent as an example instance of both left and right intermediate SHC-rendering matrices 254A, 254B) (326). In some examples, audio playback device 200 may be configured with intermediate SHC-rendering matrix 335 for application to the HOA content 316 (or reduced version thereof, e.g., HOA content 321). In some examples, reduction unit 228 may apply further reductions to computation by using only one of the left or right components of matrix 317 (328).

Audio playback device 200 receives HOA content 316 of order $N_I$ and length Length and, in some aspects, applies an order reduction operation to reduce the order of the spherical harmonic coefficients (SHCs) therein to N (330). $N_I$ indicates the order of the (I)nput HOA content 321. The HOA content 321 of order reduction operation (330) is, like HOA content 316, in the SHC domain. The optional order reduction operation also generates and provides the highest-order (e.g., the $0^{th}$ order) signal 319 to residual response unit 210 for a fast convolution operation (338). In instances in which HOA order reduction unit 204 does not reduce an order of HOA content 316, the apply fast convolution operation (332) operates on input that does not have a reduced order. In either case, HOA content 321 input to the fast convolution operation (332) has dimensions [Length, $(N+1)^2$], where N is the order.

Audio playback device 200 may apply fast convolution of HOA content 321 with matrix 335 to produce HOA signal 323 having left and right components thus dimensions [Length, $(N+1)^2$, 2] (332). Again, fast convolution may refer to point-wise multiplication of the HOA content 321 and matrix 335 in the frequency domain or convolution in the time domain. Audio playback device 200 may further sum HOA signal 323 over $(N+1)^2$ to produce a summed signal 325 having dimensions [Length, 2] (334).

Returning now to residual matrix 339, audio playback device 200 may combine the L residual room response segments, in accordance with techniques herein described, to generate a common residual room response matrix 327 having dimensions [b, 2] (336). Audio playback device 200 may apply fast convolution of the $0^{th}$ order HOA signal 319 with the common residual room response matrix 327 to produce room response signal 329 having dimensions [Length, 2] (338). Because, to generate the L residual response room response segments of residual matrix 339, audio playback device 200 obtained the residual response room response segments starting at the $(a+1)^{th}$ samples of the L filters of BRIR data 312, audio playback device 200 accounts for the initial a samples by delaying (e.g., padding) a samples to generate room response signal 311 having dimensions [Length, 2] (340).

Audio playback device 200 combines summed signal 325 with room response signal 311 by adding the elements to produce output signal 318 having dimensions [Length, 2] (342). In this way, audio playback device may avoid applying fast convolution for each of the L residual room response segments. For a 22 channel input for conversion to binaural audio output signal, this may reduce the number of fast convolutions for generating the residual room response from 22 to 2.

Figure 10B:
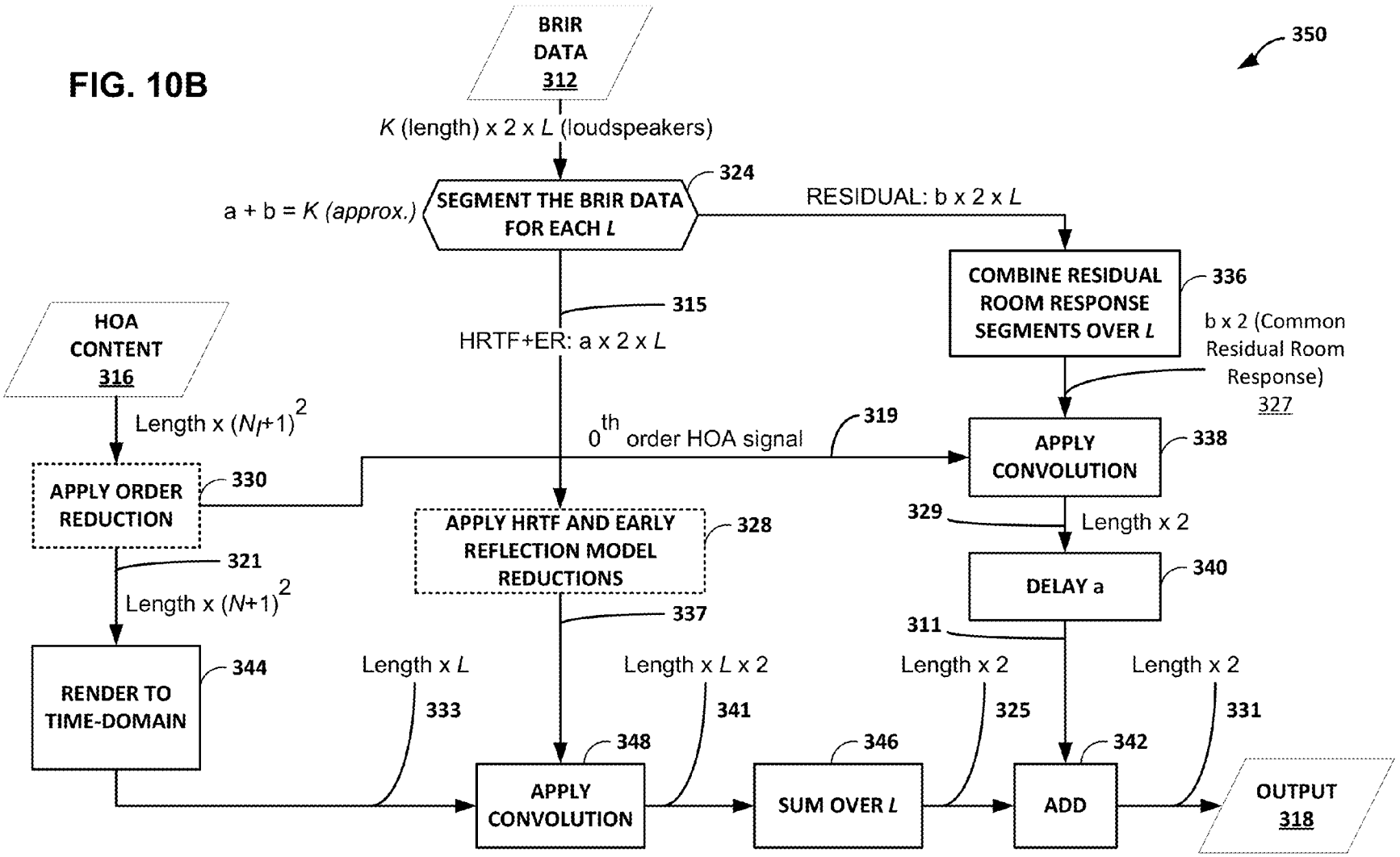

FIG. 10B is a diagram illustrating an example mode of operation 350 that may be performed by the audio playback devices of FIGS. 7 and 8 in accordance with various aspects of the techniques described in this disclosure. Mode of operation 350 is described herein after with respect to audio playback device 200 of FIG. 8 and is similar to mode of operation 310. However, mode of operation 350 includes first rendering the HOA content into multichannel speaker signals in the time domain for L real or virtual loudspeakers, and then applying efficient BRIR filtering on each of the speaker feeds, in accordance with techniques described herein. To that end, audio playback device 200 transforms HOA content 321 to multichannel audio signal 333 having dimensions [Length, L] (344). In addition, audio playback device does not transform BRIR data 312 to the SHC domain. Accordingly, applying reduction by audio playback device 200 to signal 314 generates matrix 337 having dimensions [a, 2, L] (328).

Audio playback device 200 then applies fast convolution 332 of multichannel audio signal 333 with matrix 337 to produce multichannel audio signal 341 having dimensions [Length, L, 2] (with left and right components) (348). Audio playback device 200 may then sum the multichannel audio signal 341 by the L channels/speakers to produce signal 325 having dimensions [Length, 2] (346).

Figure 11:
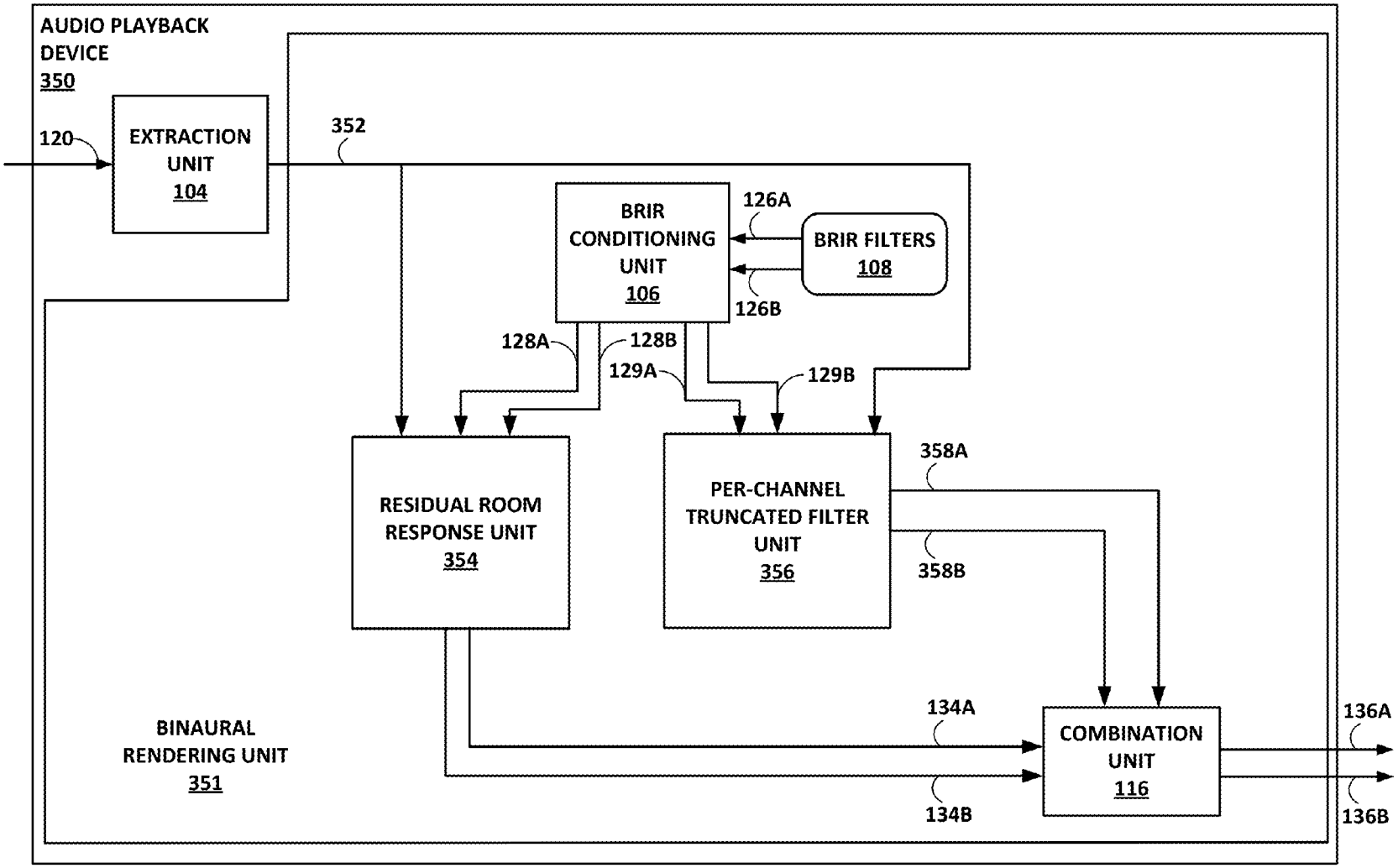
FIG. 11 is a block diagram illustrating an example of an audio playback device that may perform various aspects of the binaural audio rendering techniques described in this disclosure.

FIG. 11 is a block diagram illustrating an example of an audio playback device 350 that may perform various aspects of the binaural audio rendering techniques described in this disclosure. While illustrated as a single device, i.e., audio playback device 350 in the example of FIG. 11, the techniques may be performed by one or more devices. Accordingly, the techniques should be not limited in this respect.

Moreover, while generally described above with respect to the examples of FIGS. 1-10B as being applied in the spherical harmonics domain, the techniques may also be implemented with respect to any form of audio signals, including channel-based signals that conform to the above noted surround sound formats, such as the 5.1 surround sound format, the 7.1 surround sound format, and/or the 22.2 surround sound format. The techniques should therefore also not be limited to audio signals specified in the spherical harmonic domain, but may be applied with respect to any form of audio signal. As used herein, A "and/or" B may refer to A, B, or a combination of A and B.

As shown in the example of FIG. 11, the audio playback device 350 may be similar to the audio playback device 100 shown in the example of FIG. 7. However, the audio playback device 350 may operate or otherwise perform the techniques with respect to general channel-based audio signals that, as one example, conform to the 22.2 surround sound format. The extraction unit 104 may extract audio channels 352, where audio channels 352 may generally include "n" channels, and is assumed to include, in this example, 22 channels that conform to the 22.2 surround sound format. These channels 352 are provided to both residual room response unit 354 and per-channel truncated filter unit 356 of the binaural rendering unit 351.

As described above, the BRIR filters 108 include one or more BRIR filters and may represent an example of the BRIR filters 37 of FIG. 3. The BRIR filters 108 may include the separate BRIR filters 126A, 126B representing the effect of the left and right HRTF on the respective BRIRs.

The BRIR conditioning unit 106 receives n instances of the BRIR filters 126A, 126B, one for each channel n and with each BRIR filter having length N. The BRIR filters 126A, 126B may already be conditioned to remove quiet samples. The BRIR conditioning unit 106 may apply techniques described above to segment the BRIR filters 126A, 126B to identify respective HRTF, early reflection, and residual room segments. The BRIR conditioning unit 106 provides the HRTF and early reflection segments to the per-channel truncated filter unit 356 as matrices 129A, 129B representing left and right matrices of size [a, L], where a is a length of the concatenation of the HRTF and early reflection segments and n is a number of loudspeakers (virtual or real). The BRIR conditioning unit 106 provides the residual room segments of BRIR filters 126A, 126B to residual room response unit 354 as left and right residual room matrices 128A, 128B of size [b, L], where b is a length of the residual room segments and n is a number of loudspeakers (virtual or real).

The residual room response unit 354 may apply techniques describe above to compute or otherwise determine left and right common residual room response segments for convolution with the audio channels 352. That is, residual room response unit 110 may receive the left and right residual room matrices 128A, 128B and combine the respective left and right residual room matrices 128A, 128B over n to generate left and right common residual room response segments. The residual room response unit 354 may perform the combination by, in some instances, averaging the left and right residual room matrices 128A, 128B over n.

The residual room response unit 354 may then compute a fast convolution of the left and right common residual room response segments with at least one of audio channel 352. In some examples, the residual room response unit 352 may receive, from the BRIR conditioning unit 106, a value for an onset time of the common residual room response segments. Residual room response unit 354 may zero-pad or otherwise delay the output signals 134A, 134B in anticipation of combination with earlier segments for the BRIR filters 108. The output signals 134A may represent left audio signals while the output signals 134B may represent right audio signals.

The per-channel truncated filter unit 356 (hereinafter "truncated filter unit 356") may apply the HRTF and early reflection segments of the BRIR filters to the channels 352. More specifically, the per-channel truncated filter unit 356 may apply the matrixes 129A and 129B representative of the HRTF and early reflection segments of the BRIR filters to each one of the channels 352. In some instances, the matrixes 129A and 129B may be combined to form a single matrix 129. Moreover, typically, there is a left one of each of the HRTF and early reflection matrices 129A and 129B and a right one of each of the HRTF and early reflection matrices 129A and 129B. That is, there is typically an HRTF and early reflection matrix for the left ear and the right ear. The per-channel direction unit 356 may apply each of the left and right matrixes 129A, 129B to output left and right filtered channels 358A and 358B. The combination unit 116 may combine (or, in other words, mix) the left filtered channels 358A with the output signals 134A, while combining (or, in other words, mixing) the right filtered channels 358B with the output signals 134B to produce binaural output signals 136A, 136B. The binaural output signal 136A may correspond to a left audio channel, and the binaural output signal 136B may correspond to a right audio channel.

In some examples, the binaural rendering unit 351 may invoke the residual room response unit 354 and the per-channel truncated filter unit 356 concurrent to one another such that the residual room response unit 354 operates concurrent to the operation of the per-channel truncated filter unit 356. That is, in some examples, the residual room response unit 354 may operate in parallel (but often not simultaneously) with the per-channel truncated filter unit 356, often to improve the speed with which the binaural output signals 136A, 136B may be generated. While shown in various FIGS. above as potentially operating in a cascaded fashion, the techniques may provide for concurrent or parallel operation of any of the units or modules described in this disclosure, unless specifically indicated otherwise.

Figure 12:
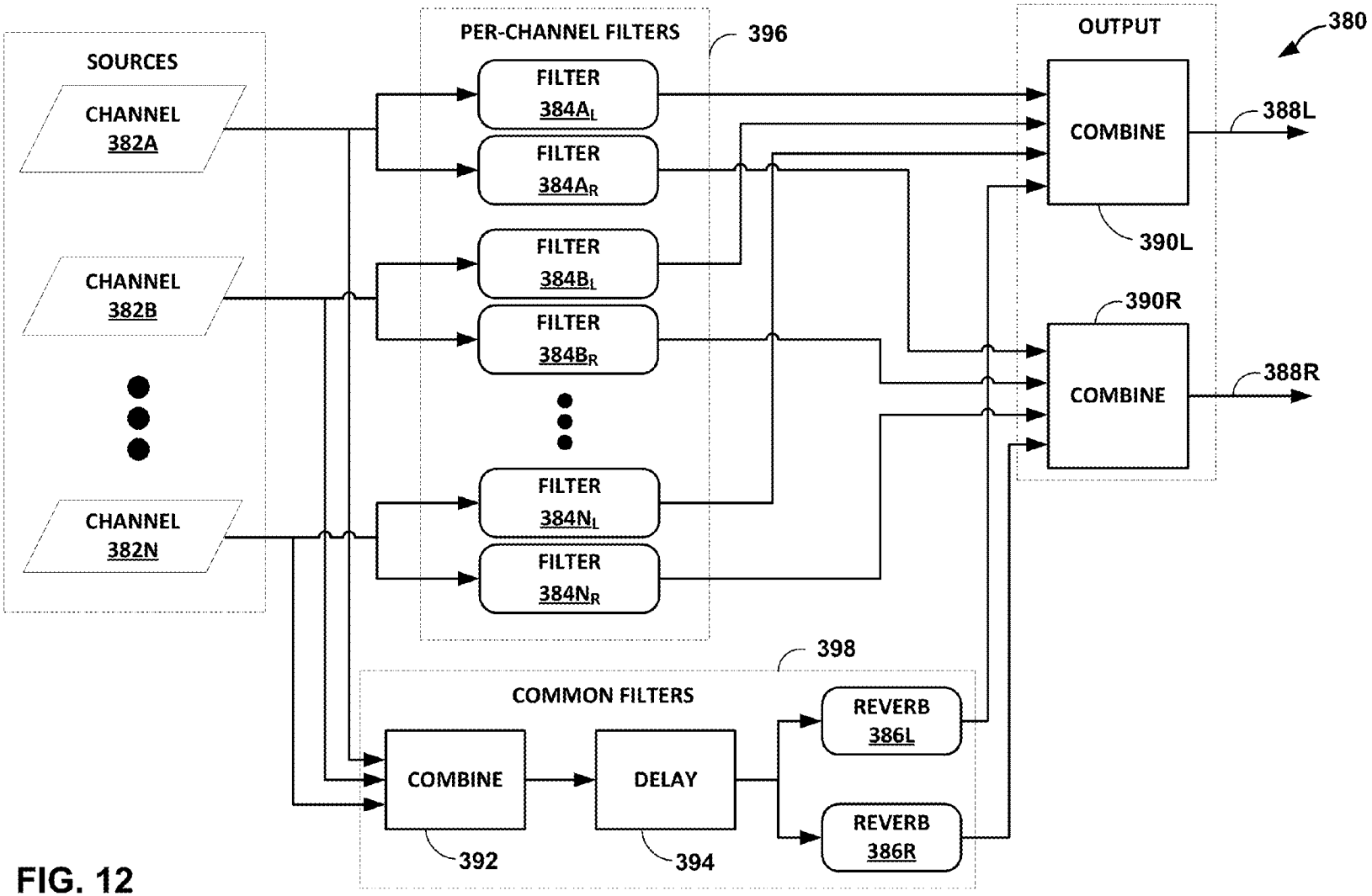
FIG. 12 is a flow diagram illustrating a process that may be performed by the audio playback device of FIG. 11 in accordance with various aspects of the techniques described in this disclosure.

FIG. 12 is a diagram illustrating a process 380 that may be performed by the audio playback device 350 of FIG. 11 in accordance with various aspects of the techniques described in this disclosure. Process 380 achieves a decomposition of each BRIR into two parts: (a) smaller components which incorporate the effects of HRTF and early reflections represented by left filters 384$A_L$-384$N_L$ and by right filters 384$A_R$-384$N_R$ (collectively, "filters 384") and (b) a common 'reverb tail' that is generated from properties of all the tails of the original BRIRs and represented by left reverb filter 386L and right reverb filter 386R (collectively, "common filters 386"). The per-channel filters 384 shown in the process 380 may represent part (a) noted above, while the common filters 386 shown in the process 380 may represent part (b) noted above.

The process 380 performs this decomposition by analyzing the BRIRs to eliminate inaudible components and determine components which comprise the HRTF/early reflections and components due to late reflections/diffusion. This results in an FIR filter of length, as one example, 2704 taps, for part (a) and an FIR filter of length, as another example, 15232 taps for part (b). According to the process 380, the audio playback device 350 may apply only the shorter FIR filters to each of the individual n channels, which is assumed to be 22 for purposes of illustration, in operation 396. The complexity of this operation may be represented in the first part of computation (using a 4096 point FFT) in Equation (8) reproduced below. In the process 380, the audio playback device 350 may apply the common 'reverb tail' not to each of the 22 channels but rather to an additive mix of them all in operation 398. This complexity is represented in the second half of the complexity calculation in Equation (8).

In this respect, the process 380 may represent a method of binaural audio rendering that generates a composite audio signal, based on mixing audio content from a plurality of N channels. In addition, process 380 may further align the composite audio signal, by a delay, with the output of N channel filters, wherein each channel filter includes a truncated BRIR filter. Moreover, in process 380, the audio playback device 350 may then filter the aligned composite audio signal with a common synthetic residual room impulse response in operation 398 and mix the output of each channel filter with the filtered aligned composite audio signal in operations 390L and 390R for the left and right components of binaural audio output 388L, 388R.

In some examples, the truncated BRIR filter and the common synthetic residual impulse response are pre-loaded in a memory.

In some examples, the filtering of the aligned composite audio signal is performed in a temporal frequency domain.

In some examples, the filtering of the aligned composite audio signal is performed in a time domain through a convolution.

In some examples, the truncated BRIR filter and common synthetic residual impulse response is based on a decomposition analysis.

In some examples, the decomposition analysis is performed on each of N room impulse responses, and results in N truncated room impulse responses and N residual impulse responses (where N may be denoted as n or n above).

In some examples, the truncated impulse response represents less than forty percent of the total length of each room impulse response.

In some examples, the truncated impulse response includes a tap range between 111 and 17,830.

In some examples, each of the N residual impulse responses is combined into a common synthetic residual room response that reduces complexity.

In some examples, mixing the output of each channel filter with the filtered aligned composite audio signal includes a first set of mixing for a left speaker output, and a second set of mixing for a right speaker output.

In various examples, the method of the various examples of process 380 described above or any combination thereof may be performed by a device comprising a memory and one or more processors, an apparatus comprising means for performing each step of the method, and one or more processors that perform each step of the method by executing instructions stored on a non-transitory computer-readable storage medium.

Moreover, any of the specific features set forth in any of the examples described above may be combined into a beneficial example of the described techniques. That is, any of the specific features are generally applicable to all examples of the techniques. Various examples of the techniques have been described.

The techniques described in this disclosure may in some cases identify only samples 111 to 17830 across BRIR set that are audible. Calculating a mixing time $T_{mp95}$ from the volume of an example room, the techniques may then let all BRIRs share a common reverb tail after 53.6 ms, resulting in a 15232 sample long common reverb tail and remaining 2704 sample HRTF+reflection impulses, with 3 ms cross-fade between them. In terms of a computational cost break down, the following may be arrived at Common reverb tail: $10*6*\log_2(2*15232/10)$.

Remaining impulses: $22*6*\log_2(2*4096)$, using 4096 FFT to do it in one frame.

Additional 22 additions.

As a result, a final figure of Merit may therefore approximately equal $C_{mod}=\max(100*(C_{conv}-C)/C_{conv}, 0)=88.0$, where:

$$C_{mod}=\max(100*(C_{conv}-C)/C_{conv},0), \tag{6}$$

where $C_{conv}$, is an estimate of an unoptimized implementation:

$$C_{conv}=(22+2)*(10)*(6*\log_2(2*48000/10)), \tag{7}$$

C, is some aspect, may be determined by two additive factors:

$$C = 22*6*\log_2(2*4096) + 10*6*\log_2\left(2*\frac{15232}{10}\right)\Big). \tag{8}$$

Thus, in some aspects, the figure of merit, $C_{mod}=87.35$.

A BRIR filter denoted as $B_n(z)$ may be decomposed into two functions $BT_n(z)$ and $BR_n(z)$, which denote the truncated BRIR filter and the reverb BRIR filter, respectively. Part (a) noted above may refer to this truncated BRIR filter, while part (b) above may refer to the reverb BRIR filter. Bn(z) may then equal $BT_n(z)+(z^{-m}*BR_n(z))$, where m denotes the delay. The output signal Y(z) may therefore be computed as:

$$\Sigma_{n=0}^{N-1}[X_n(z)\cdot BT_n(z)+z^{-m}\cdot X_n(z)*BR_n(z)] \tag{9}$$

The process 380 may analyze the $BR_n(z)$ to derive a common synthetic reverb tail segment, where this common BR(z) may be applied instead of the channel specific $BR_n(z)$. When this common (or channel general) synthetic BR(z) is used, Y(z) may be computed as:

$$\Sigma_{n=0}^{N-1}[X_n(z)\cdot BT_n(z)+z^{-m}BR_n(z)]\cdot\Sigma_{n=0}^{N-1}X_n(z) \tag{10}$$

It should be understood that, depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially. In addition, while certain aspects of this disclosure are described as being performed by a single device, module or unit for purposes of clarity, it should be understood that the techniques of this disclosure may be performed by a combination of devices, units or modules.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol.

In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium.

It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware Various embodiments of the techniques have been described. These and other embodiments are within the scope of the following claims.

What is claimed is:

1. A method of binaural audio rendering performed by an audio playback system, the method comprising:

extracting direction-dependent segments of left and right binaural room impulse response (BRIR) filters, wherein:

the left BRIR filter comprises a left residual room response segment, the right BRIR filter comprises a right residual room response segment, each of the left and right BRIR filters comprises one of the direction-dependent segments, wherein a filter response for each of the direction-dependent segments depends on a location of a virtual speaker;

applying a rendering matrix to transform a left matrix and a right matrix to left and right filter matrices in a spherical harmonic domain respectively, the left matrix and the right matrix including the extracted direction-dependent segments of the left and right BRIR filters;

combining the left residual room response segment and the right residual room response segment to produce a left common residual room response segment and a right common residual room response segment;

convolving the left filter matrix and spherical harmonic coefficients (SHCs) to produce a left filtered SHC channel, wherein the SHCs describe a sound field;

convolving the right filter matrix and the SHCs to produce a right filtered SHC channel;

computing a fast convolution of the left common residual room response segment and at least one channel of the SHCs to produce a left residual room signal;

computing a fast convolution of the right common residual room response segment and at least one channel of the SHCs to produce a right residual room signal;

combining the left residual room signal and the left filtered SHC channel to produce a left binaural output signal; and combining the right residual room signal and the right filtered SHC channel to produce a right binaural output signal.

2. The method of claim 1, further comprising:

after applying the rendering matrix to transform the left matrix to the left filter matrix in the spherical harmonic domain and before convolving the left filter matrix and the SHCs to produce the left filtered SHC channel, modifying the left filter matrix by applying, to the left filter matrix, a first minimum phase reduction and using a first Balanced Model Truncation method to design a first Infinite Impulse Response (IIR) filter to approximate a frequency response of a minimum phase portion of the left filter matrix; and after applying the rendering matrix to transform the right matrix to the right filter matrix in the spherical harmonic domain and before convolving the right filter matrix and the SHCs to produce the right filtered SHC channel, modifying the right filter matrix by applying, to the right filter matrix, a second minimum phase reduction and using a second Balanced Model Truncation method to design a second IIR filter to approximate a frequency response of a minimum phase portion of the right filter matrix.

3. The method of claim 1, wherein:

computing the fast convolution of the left common residual room response segment and at least one channel of the SHCs to produce the left residual room signal comprises convolving the left common residual room response segment only with a highest-order channel of the SHCs to produce the left residual room signal; and computing the fast convolution of the right common residual room response segment and at least one channel of the SHCs to produce the right residual room signal comprises convolving the right common residual room response segment with only the highest-order channel of the SHCs to produce the right residual room signal.

4. The method of claim 1, the method further comprising:

zero-padding the left residual room signal with an onset number of samples; and zero-padding the right residual room signal with the onset number of samples.

5. The method of claim 1, wherein the left and right BRIR filters are conditioned to remove samples of initial phases of the left and right BRIR filters.

6. A device comprising:

a memory; and one or more processors configured to:

extract direction-dependent segments of left and right binaural room impulse response (BRIR) filters, wherein:

the left BRIR filter comprises a left residual room response segment, the right BRIR filter comprises a right residual room response segment, each of the left and right BRIR filters comprises one of the direction-dependent segments, wherein a filter response for each of the direction-dependent segments depends on a location of a virtual speaker;

apply a rendering matrix to transform a left matrix and a right matrix to left and right filter matrices in a spherical harmonic domain respectively, the left matrix and the right matrix including the extracted direction-dependent segments of the left and right BRIR filters;

combine the left residual room response segment and the right residual room response segment to produce a left common residual room response segment and a right common residual room response segment;

convolve the left filter matrix and spherical harmonic coefficients (SHCs) to produce a left filtered SHC channel, wherein the SHCs describe a sound field;

convolve the right filter matrix and the SHCs to produce a right filtered SHC channel;

compute a fast convolution of the left common residual room response segment and at least one channel of the SHCs to produce a left residual room signal;

compute a fast convolution of the right common residual room response segment and at least one channel of the SHCs to produce a right residual room signal;

combine the left residual room signal and the left filtered SHC channel to produce a left binaural output signal; and combine the right residual room signal and the right filtered SHC channel to produce a right binaural output signal.

7. The device of claim 6, wherein the one or more processors are configured such that:

after applying the rendering matrix to transform the left matrix to the left filter matrix in the spherical harmonic domain and before convolving the left filter matrix and the SHCs to produce the left filtered SHC channel, the one or more processors modify the left filter matrix by applying, to the left filter matrix, a first minimum phase reduction and by using a first Balanced Model Truncation method to design a first Infinite Impulse Response (IIR) filter to approximate a frequency response of a minimum phase portion of the left filter matrix; and after applying the rendering matrix to transform the right matrix to the right filter matrix in the spherical harmonic domain and before convolving the right filter matrix and the SHCs to produce the right filtered SHC channel, the one or more processors modify the right filter matrix by applying, to the right filter matrix, a second minimum phase reduction and by using a second Balanced Model Truncation method to design a second IIR filter to approximate a frequency response of a minimum phase portion of the right filter matrix.

8. The device of claim 6, wherein:

to compute the fast convolution of the left common residual room response segment and the at least one channel of the SHCs to produce the left residual room signal, the one or more processors convolve the left common residual room response segment only with a highest-order element of the SHCs to produce the left residual room signal; and to compute the fast convolution of the right common residual room response segment and the at least one channel of the SHCs to produce the right residual room signal, the one or more processors convolve the right common residual room response segment with only the highest-order channel of the SHCs to produce the right residual room signal.

9. The device of claim 6, wherein the one or more processors are further configured to:

zero-pad the left residual room signal with an onset number of samples; and zero-pad the right residual room signal with the onset number of samples.

10. The device of claim 6, wherein the left and right BRIR filters are conditioned to remove samples of initial phases of the left and right BRIR filters.

11. An apparatus comprising:

means for extracting direction-dependent segments of left and right binaural room impulse response (BRIR) filters, wherein:

the left BRIR filter comprises a left residual room response segment, the right BRIR filter comprises a right residual room response segment, each of the left and right BRIR filters comprises one of the direction-dependent segments, wherein a filter response for each of the direction-dependent segments depends on a location of a virtual speaker;

means for applying a rendering matrix to transform a left matrix and a right matrix to left and right filter matrices in a spherical harmonic domain respectively, the left matrix and the right matrix including the extracted direction-dependent segments of the left and right BRIR filters;

means for combining the left residual room response segment and the right residual room response segment to produce a left common residual room response segment and a right common residual room response segment;

means for convolving the left filter matrix and spherical harmonic coefficients (SHCs) to produce a left filtered SHC channel, wherein the SHCs describe a sound field;

means for convolving the right filter matrix and the SHCs to produce a right filtered SHC channel;

means for computing a fast convolution of the left common residual room response segment and at least one channel of the SHCs to produce a left residual room signal;

means for computing a fast convolution of the right common residual room response segment and at least one channel of the SHCs to produce a right residual room signal;

means for combining the left residual room signal and the left filtered SHC channel to produce a left binaural output signal; and means for combining the right residual room signal and the right filtered SHC channel to produce a right binaural output signal.

12. The apparatus of claim 11, further comprising:

means for modifying, after applying the rendering matrix to transform the left matrix to the left filter matrix in the spherical harmonic domain and before convolving the left filter matrix and the SHCs to produce the left filtered SHC channel, the left filter matrix by applying, to the left filter matrix, a first minimum phase reduction and using a first Balanced Model Truncation method to design a first Infinite Impulse Response (IIR) filter to approximate a frequency response of a minimum phase portion of the left filter matrix; and means for modifying, after applying the rendering matrix to transform the right matrix to the right filter matrix in the spherical harmonic domain and before convolving the right filter matrix and the SHCs to produce the right filtered SHC channel, the right filter matrix by applying, to the right filter matrix, a second minimum phase reduction and using a second Balanced Model Truncation method to design a second IIR filter to approximate a frequency response of a minimum phase portion of the right filter matrix.

13. The apparatus of claim 11, wherein the means for computing the fast convolution of the left common residual room response segment and the at least one channel of the SHCs comprises means for convolving the left common residual room response segment only with a highest-order channel of the SHCs to produce the left residual room signal; and wherein the means for computing the fast convolution of the right common residual room response segment and the at least one channel of the SHCs comprises means for convolving the right common residual room response segment with only the highest-order channel of the SHCs to produce the right residual room signal.

14. The apparatus of claim 11, the apparatus further comprising:

means for zero-padding the left residual room signal with an onset number of samples; and means for zero-padding the right residual room signal with the onset number of samples.

15. The apparatus of claim 11, wherein the left and right BRIR filters are conditioned to remove samples of initial phases of the left and right BRIR filters.

16. A non-transitory computer-readable storage medium having stored thereon instructions that, when executed, cause one or more processors to:

extract direction-dependent segments of left and right binaural room impulse response (BRIR) filters, wherein:

the left BRIR filter comprises a left residual room response segment, the right BRIR filter comprises a right residual room response segment, each of the left and right BRIR filters comprises one of the direction-dependent segments, wherein a filter response for each of the direction-dependent segments depends on a location of a virtual speaker;

apply a rendering matrix to transform a left matrix and a right matrix to left and right filter matrices in a spherical harmonic domain respectively, the left matrix and the right matrix including the extracted direction-dependent segments of the left and right BRIR filters;

combine the left residual room response segment and the right residual room response segment to produce a left common residual room response segment and a right common residual room response segment;

convolve the left filter matrix and spherical harmonic coefficients (SHCs) to produce a left filtered SHC channel, wherein the SHCs describe a sound field;

convolve the right filter matrix and the SHCs to produce a right filtered SHC channel;

compute a fast convolution of the left common residual room response segment and at least one channel of the SHCs to produce a left residual room signal;

compute a fast convolution of the right common residual room response segment and at least one channel of the SHCs to produce a right residual room signal;

combine the left residual room signal and the left filtered SHC channel to produce a left binaural output signal; and combine the right residual room signal and the right filtered SHC channel to produce a right binaural output signal.

17. The non-transitory computer-readable storage medium of claim 16, wherein the left and right BRIR filters are conditioned to remove samples of initial phases of the left and right BRIR filters.

* * * * *